US006098672A

United States Patent [19]

Kiholm

[11] Patent Number: 6,098,672

[45] Date of Patent: Aug. 8, 2000

[54] METHOD AND APPARATUS FOR A PRODUCT RECOVERY SYSTEM

[75] Inventor: Robert Kiholm, Selah, Wash.

[73] Assignee: Kiholm Industries LLC, Yakima, Wash.

[21] Appl. No.: 09/232,268

[22] Filed: Jan. 15, 1999

[51] Int. Cl.[7] ..... B65B 1/04

[52] U.S. Cl. ..... 141/1; 141/2; 141/91

[58] Field of Search ..... 141/1, 2, 18, 69, 141/70, 98, 85, 89, 91, 231, 86, 87, 90; 134/22.18

[56] References Cited

U.S. PATENT DOCUMENTS

| | | | |
|---|---|---|---|
| 4,051,034 | 9/1977 | Amon et al. | 210/206 |
| 4,112,828 | 9/1978 | Mojonnier et al. | 99/275 |
| 4,242,841 | 1/1981 | Ushakov et al. | 51/263 |
| 4,531,456 | 7/1985 | Kemp, Jr. et al. | 99/323 |
| 4,669,889 | 6/1987 | Yamaguchi et al. | 366/177 |
| 4,708,827 | 11/1987 | McMillin | 261/35 |
| 4,717,515 | 1/1988 | Forsyth et al. | 261/122 |
| 4,737,037 | 4/1988 | Mojonnier | 366/152 |
| 4,742,939 | 5/1988 | Galockin | 222/68 |
| 4,857,355 | 8/1989 | Gregg | 426/590 |
| 4,944,601 | 7/1990 | Damon | 366/160 |
| 5,141,011 | 8/1992 | Bjerklund et al. | 137/3 |
| 5,431,198 | 7/1995 | Turtchan et al. | 141/1 |
| 5,531,240 | 7/1996 | Kelada | 137/15 |
| 5,713,263 | 2/1998 | Burks, III | 99/323 |

OTHER PUBLICATIONS

"Focus on Hot Fill," *Beverage World*, Jul. 1998, pp. 74–75.

*Primary Examiner*—Steven O. Douglas
*Assistant Examiner*—Peter deVore
*Attorney, Agent, or Firm*—Stratton Ballew PLLC

[57] ABSTRACT

A method and apparatus are provided for recovering a product from a filling line being used to fill containers with the product. The filling line comprises at least a filler, a pump, a check valve, compressed air/gas, a water source, and a holding tank containing the product, all interconnected by a product line. In the method, the filling line is rinsed, and the rinse water is then evacuated from the filling line using compressed air/gas. Next, using a pump, the product is transferred from the holding tank through the filler line to the filler, and then into containers. The transfer continues until the pump is no longer primed with the product. The remaining product is then pushed with the compressed air/gas through the filler line into the filler and then into containers, thereby recovering substantially all the product remaining in the filler line. The product recovery method minimizes the amount of waste product that must be discarded from a bottling line.

3 Claims, 7 Drawing Sheets

| FIG. 1 |
| --- |
| FIG. 2 |

METHOD AND APPARATUS FOR A PRODUCT RECOVERY SYSTEM

TECHNICAL FIELD

This invention relates to the field of product recovery in filling lines used to fill containers, including bottling lines and can lines used to fill containers in the food, beverage, and pharmaceutical industries.

BACKGROUND OF THE INVENTION

The bottling and canning industry is devoted to filling containers with a tremendous variety of products. These products vary in terms of their viscosity, ranging from high viscosity products such as peanut butter, salad dressings, and frozen concentrated juices; medium viscosity products, such as pharmaceutical syrups, soups, stews, and sauces; to low viscosity products such as wine and juices. These products also vary in terms of their properties, one the most notable of which is the presence of absence of carbonation. Champagne, beer, and soda pop beverages are all good examples of either naturally or artificially carbonated beverages.

The bottling line designs presently used are burdened with serious problems in the area of product recovery. The "product recovery problem" means that periodically a significant quantity of product in the bottling line becomes waste that cannot be economically recovered for later use. The product recovery problem typically arises in several situations with present bottling line designs. For example, because of the current design of bottling lines, if a bottling line is used to fill containers with a variety of different products over the course of a day or a week, then each time a bottling run for one product ends and a bottling run for a different product begins, a considerable amount of both products becomes unrecoverable waste. Current bottling line designs also cause a considerable amount of perishable products, or products requiring special handling to ensure product integrity or purity (such as carbonated products which must be maintained at a constant temperature during the bottling process), to become unrecoverable waste at the end of each work day, or bottling run, or product change.

It is a regrettable fact that much of the unrecoverable product waste currently created by the bottling industry is often literally dumped down the drain, or is stored in drums to later be taken to a landfill, or, for certain potentially hazardous products, to an appropriate hazardous waste disposal facility. In the case of food and beverage products, this unrecoverable waste is most often dumped down the drain. The "drain dumping" disposal method costs the bottler more than just the value of the wasted product, because this wasted product must be treated before it is reintroduced back into the environment.

For those bottling companies without their own waste water treatment facility, the waste product dumped into the drain travels through the sewage system to the local sewage treatment facility. The high sugar content of most wasted products then causes a population explosion in the bacteria at the sewage treatment facility. The bacteria used by sewage treatment facilities is "aerobic" bacteria, which means they use up oxygen as they consume sewage waste. Sewage treatment plants maintain a careful balance between their bacteria's population and the incoming sewage waste, to ensure adequate oxygen for their bacteria to survive. Sewage treatment plants make every effort to ensure that their entire system remains aerobic (with oxygen) rather than anaerobic (without oxygen). Aerobic bacteria do not create offensive odors when they consume sewage waste. Anaerobic bacteria create offensive odors, and are less efficient than aerobic bacteria at disposing of sewage waste. Sewage treatment plants track precisely how much high sugar content industrial waste is dumped into their system, and they charge each company dumping this waste a Biological Oxygen Demand (BOD) assessment. Presently, the BOD assessment for many bottling plants ranges from $25,000 to $100,000 per month.

Sewage treatment plants also track precisely the quantity of suspended solids contained in the waste stream they receive from industrial sources, because the required treatment of these suspended solids is expensive. Suspended solids are present in unfiltered fruit juices, soups, sauces, peanut butter, condiments, and a wide variety of other products. In addition to a monthly B.O.D. assessment, sewage treatment plants also charge their industrial sewage sources a monthly suspended solids assessment. Presently, the suspended solids assessment for many bottling and canning plants ranges from $25,000 to $250,000 per month.

For those bottling companies that elect to build their own waste water treatment facility, they must incur the expense of building, maintaining, and operating their own facility. This cost, which can be considerable, is often incurred primarily because of their decision to dump wasted product down the drain.

The magnitude of the product recovery problem is surprisingly large. On a daily basis, many bottling companies are dumping 500 to 2500 gallons of wasted product down the drain, or into drums for landfill disposal, for each bottling line they operate. Many bottling companies operate multiple bottling lines in each of their bottling plants. Accordingly, there is a great need for a solution to the problem of product recovery. Such a solution must maintain product integrity and product purity throughout the entire recovery process.

SUMMARY OF INVENTION

This invention provides a method and apparatus for recovering a product from a filling line being used to fill containers with the product. The filling line comprises at least a filler, a pump, a check valve, compressed air/gas, a water source, and a holding tank containing the product, all interconnected by a product line. In the method, the filling line is rinsed, and the rinse water is then evacuated from the filling line using compressed air/gas. Next, using a pump, the product is transferred from the holding tank through the filler line to the filler, and then into containers. The transfer continues until the pump is no longer primed with the product. The remaining product is then pushed with the compressed air/gas through the filler line into the filler and then into containers, thereby recovering substantially all the product remaining in the filler line.

In an additional embodiment, the invention provides a method and apparatus for recovering a product during the transfer of the product between a tanker truck and a tank.

In yet a further embodiment, the invention provides a method and apparatus for recovering a product during the transfer of the product between the holding tank and a receiving tank.

In yet a further embodiment, the invention provides a method and apparatus for maintaining the product at a desired temperature while substantially all of the product is recovered from the filling line.

The invention has the advantage of providing a method and apparatus for product recovery which minimizes the amount of waste product that must be discarded from a bottling line when the line is shut down, or a change is made from one product to another.

BRIEF DESCRIPTION OF DRAWINGS

FIG. 2A shows the relationship between FIGS. 2 and 4;

FIG. 2B shows the relationship between FIGS. 2 and 5;

FIG. 2C shows the relationship between FIGS. 2 and 6;

FIG. 2D shows the relationship between FIGS. 2 and 7;

DETAILED DESCRIPTION OF SPECIFIC EMBODIMENTS

I. Truck-to-tank product recovery

Figures 1, 1A:
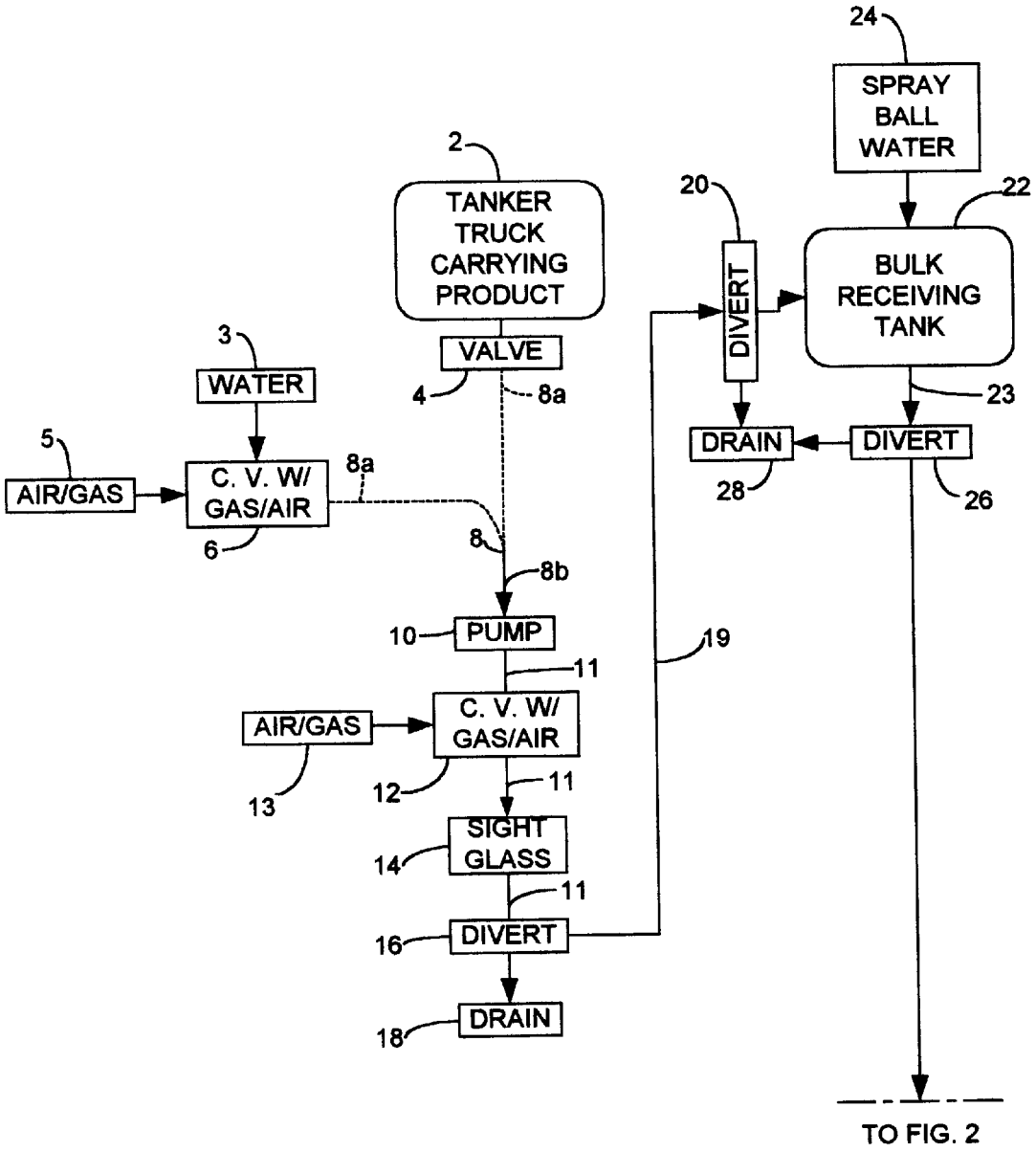
FIG. 1 is a schematic flow diagram of a preferred embodiment of the present invention showing a method and apparatus for the recovery of product during the transfer of product from a tanker truck to a tank.
FIG. 1A shows the relationship between FIGS. 1 and 2.

Container filling facilities, such as bottling plants, fill containers with a wide variety of products, such as juice, juice concentrate, carbonated beverages, wine, beer, liquid medicines, and motor oil—to name a few. The product is often transported to a container filling facility by a tanker truck in liquid form, either as a concentrate, or as ready-to-use product. In that event, the following method and apparatus depicted in FIG. 1 can be used to recover substantially all of the product from the tanker truck for storage in a tank for later use.

A. Initial water rinse procedure

In order to prepare the system for the transfer of a product from a tanker truck 2 to a tank such as a bulk receiving storage tank 22 (which functions as a receiving tank for the product), the first step is to send water 3 through a tanker truck first check valve 6 and then through a flexible food grade USDA approved hose 8 removably connected at its first end 8*a* to the tanker truck first check valve 6 and permanently connected at its second end 8*b* to a tanker truck pump 10. The water thus primes pump 10. Activate pump 10, sending water 3 sequentially through a tanker truck product line 11, a tanker truck second check valve 12, a tanker truck sight glass 14, and a tanker truck divert valve 16. Divert valve 16 is opened so that water 3 continues through a bulk receiving tank product intake line 19 to a bulk receiving tank first divert valve 20, and into a bulk receiving tank 22. Water 3 is preferably pumped through all of this equipment at a flow rate approximately equivalent to 80 g.p.m. within a schedule 40 steel pipe having a nominal diameter of 2 inches, for approximately 60 seconds, or as needed to adequately flush and rinse the equipment. Discontinue the flow of water 3 and allow the water to drain from the lines and equipment into bulk receiving tank 22.

Close the bulk receiving tank first divert valve 20 and bulk receiving tank second divert valve 26 from its initially closed position. The second divert valve is preferably located at or near the bottom of the bulk receiving tank. Rinse the bulk receiving tank 22 by spraying bulk receiving tank spray ball water 24 through a spray ball (not shown) inside of bulk receiving tank 22 preferably for approximately 60 seconds at a flow rate approximately equivalent to 80 g.p.m. within a schedule 40 steel pipe having a nominal diameter of 2 inches, or as required to adequately rinse the tank. Then open the second divert valve 26 and allow the water which has accumulated in the bulk receiving tank to drain into a bulk receiving tank drain 28.

B. Rinse water air/gas evacuation procedure

Because the pumps used for tanker truck pump 10 are typically large, twenty or more gallons of water will often remain after water 3 is allowed to drain from pump 10. To thoroughly clear the pump 10 of water, send compressed air/gas 5 through first check valve 6 through hose 8 and into and through pump 10, preferably for approximately 10 seconds at a flow rate approximately equivalent to 80 c.f.m. within a schedule 40 steel pipe having a nominal diameter of 2 inches, or as required to clear hose 8 and pump 10, and to push any of water 3 remaining in the product line 11 past the second check valve 12.

Send compressed air/gas 13 through second check valve 12, preferably for approximately 2 minutes at a flow rate approximately equivalent to 80 c.f.m. within a schedule 40 steel pipe having a nominal diameter of 2 inches, through product line 11, tanker truck sight glass 14, divert valve 16, bulk receiving tank intake product line 19, first divert valve 20, and bulk receiving tank 22. The actual flow rate and flow duration of the compressed air/gas needed to thoroughly expel the rinse water from the system is based upon the size and length of tanker truck product line 11 and bulk receiving tank product intake line 19. After the compressed air/gas 13 has expelled all of the remaining water 3 into bulk receiving tank 22, allow all of the accumulated water to drain completely from the bulk receiving tank 22 through second divert valve 26 opened to drain 28.

C. Comparison to prior art

At this point, prepare to pump the product from tanker truck 2 to the bulk receiving tank 22. Because there is an insignificant amount of water remaining in the system between hose 8 and bulk receiving tank 22 at this stage of the process, the product from the tanker truck 2 can flow through the system at without any detectable dilution by the rinse water. This is in marked contrast to prior methods and apparatus, which would have rinsed the entire system with water, and then would have used the product flowing from tanker truck 2 to push the rinse water through the system into bulk receiving tank 22. Under the prior approach, a substantial amount of product would have to run through the entire system before the product flowing through the bulk receiving tank product intake line 19 returned to its undiluted state. Under the prior approach, the diluted product which had accumulated in the bulk receiving tank 22 would then be discarded by dumping it into drain 28. In the present invention, the problem of discarding diluted, unusable product is virtually eliminated, because compressed air/gas 5 and 13 (which is optionally food and drug quality compressed air/gas) is used to evacuate the rinse water prior to introducing any product into the system.

D. Product transfer

In order to prepare to pump the product from tanker truck 2 to the bulk receiving tank 22, close bulk receiving tank second divert valve 26. Disconnect the first end 8*a* of flexible hose 8 from first check valve 6 and connect it to a tanker truck valve 4 locate on the tanker truck 2. Open the tanker truck valve 4, so that product flows into the hose 8, and into the pump 10. Activate pump 10 and pump product from tanker truck 2 to the bulk receiving tank 22, preferably until tanker truck 2 is empty.

At this point, tanker truck product line 11 and all the equipment it interconnects, and bulk storage tank product intake 19 and all the equipment it interconnects, are all charged with undiluted, usable product. With the tanker truck 2 empty, the pump 10, has no more product to pump, and thus cannot clear the system of product.

E. Product recovery procedure

Under the prior approach, before the present invention, the product in the system at this point would be pushed through the tanker truck product line 11 and the bulk storage tank intake product line 19 by rinse water, thus diluting a substantial quantity of the remaining product and rendering it unusable. This diluted product would then be dumped to a drain—a wasteful and costly approach.

In the present invention, the product left in the tanker truck product line 11 and the bulk storage tank intake product line 19 is recovered using the air/gas evacuation approach. After the pump 10 can no longer push any further product down the tanker truck product line 11, deactivate the pump. Disconnect the first end 8*a* of the hose 8 from the tanker truck 2, and connect the first end 8*a* to the first check valve 6.

As with the rinse water, a significant quantity of product may remain in the pump 10, because of the typical large size of the pumps used for tanker trucks pump 10. Send compressed air/gas 5 through the first check valve 6 through hose 8 and into and through pump 10 to clear hose 8 and pump 10, preferably at a flow rate approximately equivalent to 80 c.f.m. within a schedule 40 steel pipe having a nominal diameter of 2 inches, for approximately 30 seconds, or as required to in order to push any remaining product in the product line 11 past the second check valve 12.

Immediately send compressed air/gas 13 through second check valve 12 into the tanker truck product line 11, the tanker truck sight glass 14, the tanker truck divert valve 16, the bulk receiving tank intake product line 19, the first divert valve 20, and into bulk receiving tank 22, preferably for approximately 2 minutes at a flow rate approximately equivalent to 80 c.f.m. within a schedule 40 steel pipe having a nominal diameter of 2 inches, or as required to expel all of the product remaining in the lines and equipment into the bulk receiving tank 22. Before turning off the flow of compressed air/gas 13, utilize sight glass 14, or alternately a suitable automatic sensor device, to verify that there is no product remaining in the tanker truck product line 11. Then wait for the compressed air/gas 13 to expel the remaining product in the bulk receiving tank product intake line 19 into the bulk receiving tank 22. With the compressed air/gas 13 still flowing, turn off the first divert valve 20, and open the tank truck divert valve 16 to the tanker truck drain 18. At this point a very small amount of residual product is expelled into the drain 18. Open the first divert valve 20 to the bulk receiving tank drain 28, and open the tanker truck divert valve 16 to product intake line 19. The very small amount of remaining product residue will be expelled into drain 28. Then shut off the flow of compressed air/gas 13. At this point in the process, substantially all of the product originally carried by tanker truck 2 will have been transferred to bulk receiving tank in undiluted and usable condition, leaving only an insignificant amount of product residue behind.

As an alternative, it is optional at this stage of the process to rinse the system again before using it to transfer a new product to another bulk receiving tank. In the event that the system is not rinsed at this time, it will be rinsed by use of the Initial Water Rinse procedure, described in section I.A. above, prior to the transfer of any new product.

In order to accomplish the optional rinse procedure, send water 3 through the first check valve 6, the hose 8, and into the pump 10. From the pump, water 3 continues through the tanker truck product line 11 connecting the pump 10, the second check valve 12, the sight glass 14, the divert valve 16, the product intake line 19, and into the first divert valve 20. At this point in time, first divert valve 20 remains opened to the drain 28, so that water 3 empties into the drain 28. Run water 3 through all of this equipment, preferably for approximately 90 seconds at a flow rate of approximately 80 g.p.m, or as required to adequately rinse the lines and equipment. Shut off the flow of water 3. The entire system prior to the bulk receiving tank 22 has now been rinsed clean.

The bulk storage tank 22 now contains substantially all of the product which was delivered in the tanker truck 2, with no product rendered unusable by dilution, and only an insignificant amount of the product being discarded.

F. Preferred components.

In a preferred embodiment of the truck-to-tank recovery system, the following components have been utilized successfully, although other components which function in an equivalent manner can also be used:

| | |
|---|---|
| Water 3 and 15 | Approved government standards drinking water or approved process water, meeting FDA standards, is obtained using standard filtration and treatment equipment. |
| Air/gas 5 and 13 | For food and drug related applications of the present invention, Food and Drug Administration (FDA) grade sanitary air is preferably obtained by three stage Filenco Dryer/Filters to filter and dry high pressure compressed air on a point-of-use basis immediately prior to the introduction of the compressed air/gas to the check valves 6 and 12. Alternately, regular atmosphere air, or any inert or non-reactive gas, if filtered and dried properly, can be used for compressed air/gas 5 and 13 in non-food and non-drug applications of the present invention. |
| Check Valves 6 and 12 | Tri-Clover 316 stainless steel ball check valve with Tri-Clover 316 stainless steel air/gas blow attachment. |
| Hose 8 | Goodyear brand Wineline Hose, a food grade USDA approved hose. |
| Pump 10 | Tri Clover 316 stainless steel food grade sanitary pump. Both centrifical and positive displacement type pumps have been successfully utilized. |

-continued

| | |
|---|---|
| Product Line 11 | 316 stainless steel lines, approximately two inches in diameter for this preferred embodiment. |
| Sight Glass 14 | Jensen 316 stainless steel sight glass. |
| Divert Valve 16 | Tri Clover 316 stainless steel pneumatic divert valve or Tri Clover 316 stainless steel 3 way manual valve. |
| Product Line 19 | 316 stainless steel lines, approximately two inches in diameter for this preferred embodiment. |
| Divert Valves 20 and 26 | Defonex 316 stainless steel manual butterfly valves. |
| Bulk Receiving Tank 22 | 316 stainless steel tank. Tanks manufactured by Mueller Tanks, Feldmeyer, and A.P.V. Crepaco have been successfully utilized. |

II. Tank-to-tank product recovery

Figure 2:
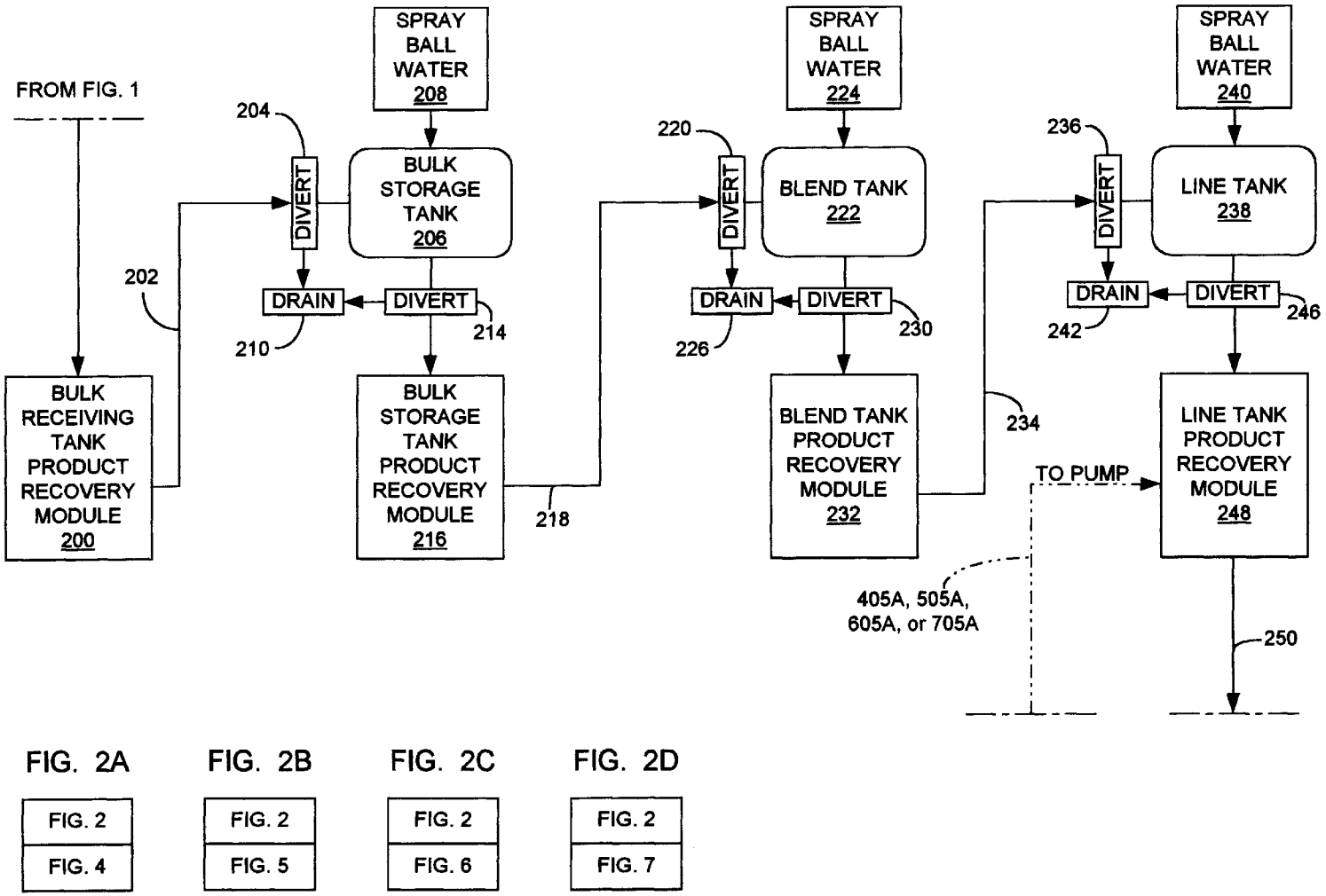
FIG. 2 is a schematic flow diagram of a preferred embodiment of the present invention showing a method and apparatus for the recovery of product during the transfer of product from one tank to another tank.
Figure 3:
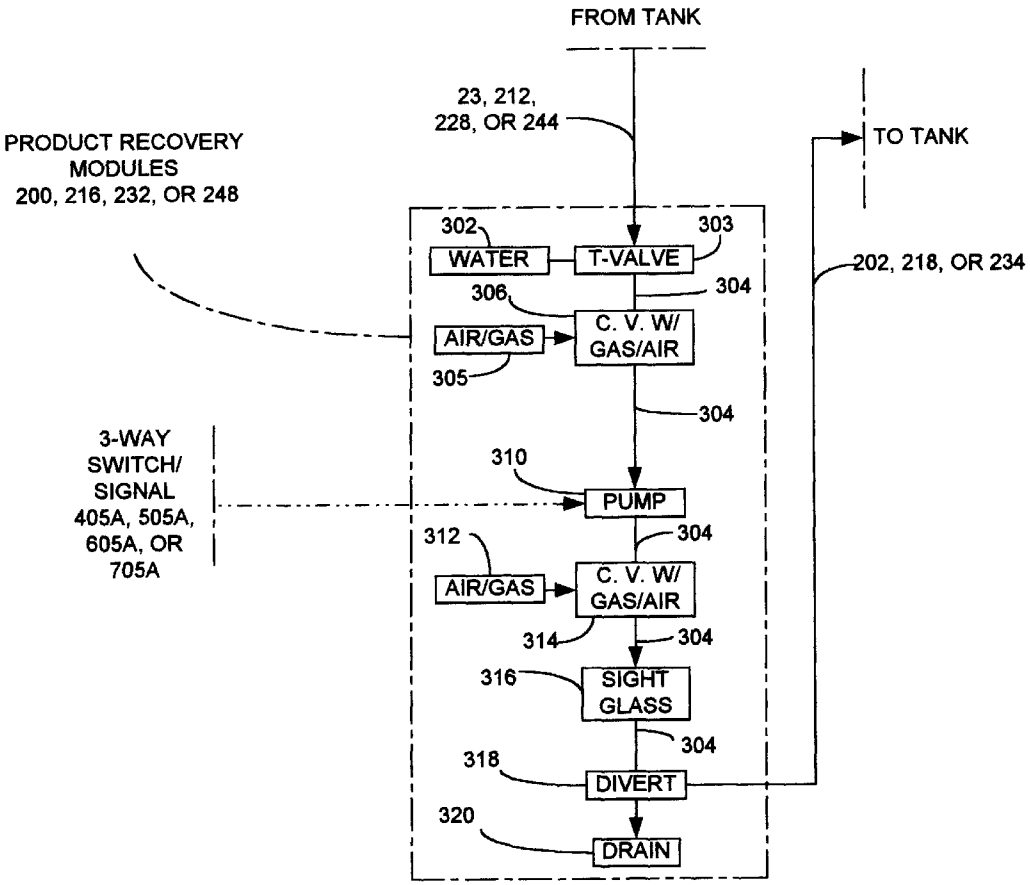
FIG. 3 is a schematic flow diagram of a preferred embodiment of the present invention showing a method and apparatus used for a product recovery module used in tank-to-tank product recovery, as shown in FIG. 2.

In a container filling facility, many processing steps require the transfer of product from a tank containing product (functioning as a holding tank) to another tank (functioning as a receiving tank for the product). The following method and apparatus can be used to recover substantially all of the product from the lines and equipment used to transfer the product from one tank to another tank. FIG. 2 depicts the process steps involved in the transfer of product among a variety of the different tanks which may be found at a typical container filling facility. The tanks described in FIG. 2, however, are intended to be representative of any tank used to store product, on either a long term and short terms basis. FIG. 3 depicts the process steps involved in actually recovering product from the lines and equipment used to transfer product from one tank to another.

A. Description of FIG. 2

The overall process of product recovery during tank-to-tank product transfer is described by the process steps depicted in FIG. 2. The specific process steps embodied in each Product Recovery Module 200, 216, 232, and 248, and the equipment necessary to effectuate those process steps, are depicted in FIG. 3, and described below following the description of FIG. 2.

1. Transfer of Product from a Bulk Receiving Tank to a Bulk Storage Tank

Once the bulk receiving tank 22 as shown in FIG. 1 has been loaded with product the system is ready to transfer product from the bulk receiving tank 22 to a bulk storage tank 206 as shown in FIG. 2 (or, alternatively, any other type of tank). Initially, close a bulk storage tank second divert valve 214, so that no rinse water can escape from the bulk storage tank 206. Then rinse the product lines and equipment in the bulk receiving tank product recovery module 200, as well as a bulk storage tank first divert valve 204 and the bulk storage tank 206, all according to the "Product Recovery Module—Initial Water Rinse Procedure" (FIG. 3, described below in Section II.B.1), with the bulk storage tank first divert valve 204 open to the bulk storage tank 206 so that rinse water 302 FIG. 3) will flow into the bulk storage tank 206. Allow the water 302 to accumulate in the bulk storage tank 206.

The second step is to evacuate the rinse water 302 from the product lines and equipment in bulk receiving tank product recovery module 200, and the first divert valve 204, into the bulk storage tank 206, using compressed air/gas, all according to the "Product Recovery Module—Rinse Water Air/Gas Evacuation Procedure" (FIG. 3, described below in Section II.B.2). After substantially all of the rinse water is pushed into the bulk storage tank 206, open the second divert valve 214 to a bulk storage tank drain 210 and allow the accumulated rinse water to drain away.

The third step is to transfer product from the bulk receiving tank 22, through the bulk receiving tank product recovery module 200, and into the bulk storage tank 206, all according to the "Product Recovery Module—Product Transfer Procedure" (FIG. 3, described below in Section II.B.3).

The fourth step is to recover substantially all the remaining product from the bulk receiving tank 22, bulk receiving tank product recovery module 200, and first divert valve 204, and expel the recovered product into the bulk storage tank 206, all according to the "Product Recovery Module Product Recovery Procedure" (FIG. 3, described below in Section II.B.4). At this stage of the process, substantially all of the product which had been contained in the bulk receiving tank 22 has now been transferred to the bulk storage tank 206 in undiluted usable form, with an insignificant amount of product discarded.

2. Transfer of Product from a Bulk Storage Tank to a Blend Tank

Once the bulk storage tank 206 has been loaded with product the system is ready to transfer product from bulk storage tank 206 to a blend tank 222 (or, alternatively, any other process tank). Initially, close the blend tank second divert valve 230 so that no rinse water 302 can escape from the blend tank 222. Then rinse the product lines and equipment in a bulk storage tank product recovery module 216, a blend tank first divert valve 220, and the blend tank 222, according to the "Product Recovery Module Initial Water Rinse Procedure" (FIG. 3, described below in Section II.B.1), with the blend tank first divert valve 220 open to the blend tank 222 so that the rinse water 302 (FIG. 3) will flow into the blend tank 222. Allow the rinse water to accumulate in the blend tank 222.

The second step is to evacuate the rinse water 302 from the product lines and equipment in the bulk storage tank product recovery module 216, first divert valve 220, and blend tank 222, using compressed air/gas, all according to the "Product Recovery Module—Rinse Water Air/Gas Evacuation Procedure" (FIG. 3, described below in Section II.B.2). After substantially all of the rinse water is pushed into the blend tank 222, open a blend tank second divert valve 230 to a blend tank drain 226 and allow the accumulated rinse water to drain away.

The third step is to transfer the product from the bulk storage tank 206, through the bulk storage tank product recovery module 216, and into the blend tank 222, all according to the "Product Recovery Module Product Transfer Procedure" (FIG. 3, described below in Section II.B.3).

The fourth step is to recover the residual product from the bulk storage tank 206, bulk storage tank product recovery module 216, and first divert valve 220, and expel the recovered product into the blend tank 222, all according to the "Product Recovery Module Product Recovery" procedure (FIG. 3, described below in Section II.B.4). At this point in time, substantially all of the product which had been contained in the bulk storage tank 206 has been transferred to the blend tank 222.

3. Transfer of Product from a Blend Tank To a Line Tank

Once the blend tank 222 has been loaded with product the system is ready to transfer product from the blend tank 222 to a line tank 238, or, alternatively, any other process tank. The blend tank 222 can also be used as a vessel in which finished product is initially created by blending water with product concentrate or powdered product.

The first step is to rinse the product lines and equipment in the blend tank product recovery module 232, a line tank first divert valve 236, and the line tank 238, according to the "Product Recovery Module—Initial Water Rinse Procedure" (FIG. 3, described below in Section II.B.1), with the line tank first divert valve 236 open to the line tank 238 so that the rinse water 302 (FIG. 3) will flow into the line tank 238. Allow water 302 to accumulate into the line tank 238.

The second step is to evacuate the rinse water from the product lines and equipment in the blend tank product recovery module 232, as well as the valve 236 and the line tank 238, using compressed air/gas, all according to the "Product Recovery Module—Rinse Water Air/Gas Evacuation Procedure" (FIG. 3, described below in Section II.B.2). After substantially all of the rinse water is pushed into the line tank 238, open a line tank second divert valve 246 to a line tank drain 242, and allow the accumulated rinse water to drain away.

The third step is to transfer product from the blend tank 222, through the blend tank product recovery module 232, and into line tank 238, all according to the "Product Recovery Module—Product Transfer Procedure" (FIG. 3, described below in Section II.B.3).

The fourth step is to recovery the residual product from the blend tank 222, the blend tank product recovery module 232, and first divert valve 236, and expel the recovered product into the line tank 238, all according to the "Product Recovery Module Product Recovery Procedure" (FIG. 3, described below in Section II.B.4). At this point in time, substantially all of the product which had been contained in the blend tank 222 has been transferred to the line tank 238.

4. Transfer of Product from a Line Tank To a Balance Tank in a Container Line Once line tank 238 has been loaded with product the system is ready to transfer product from the line tank 238 to a balance tank in a container filling line. This process is described separately in each of the four examples which follow the description of FIG. 3.

B. Description of FIG. 3

The product recovery modules consist of product lines and equipment which are operated according to sequential procedures in order to accomplish tank-to-tank product recovery. These four procedures are, in sequential order: 1) Initial Water Rinse Procedure; 2) Rinse Water Air/Gas Evacuation Procedure; 3) Product Transfer; and 4) Product Recovery Procedure.

1. Product Recovery Module—Initial Water Rinse Procedure

In order to prepare the system for the transfer of product from one tank to another tank, the first step is to send product recovery module water 302 through a product recovery module "T" valve 303 into a product recovery module product line 304 so that water 302 thoroughly rinses product line 304, a product recovery module first check valve 306, a product recovery module pump 310, a product recovery module second check valve 314, a product recovery module sight glass 316, and a product recovery module divert valve 318. The divert valve 318 is opened so that water 302 continues through the following product intake lines: the bulk storage tank product intake line 202, the blend tank product intake line 218, and line tank product intake line 234; the following divert valves: the bulk storage tank first divert valve 204, the blend tank first divert valve 220, and the line tank first divert valve 236; and into the following tanks: the bulk storage tank 206, the blend tank 222, and the line tank 238. Run water 302 through all of this equipment until it is thoroughly rinsed, preferably at a flow rate approximately equivalent to 80 g.p.m. within a schedule 40 steel pipe having a nominal diameter of 2 inches, for approximately 60 seconds, or as required. Discontinue the flow of the water 302 and allow the water to drain from the lines and equipment and accumulate in the bulk storage tank 206, the blend tank 222, or the line tank 238.

2. Product Recovery Module—Rinse Water Air/gas Evacuation Procedure

Prior to the present invention, the rinse water left in the system was pushed out of the system by using the very product which. Because a large quantity of product was diluted by this contact with the rinse water, a large quantity of product was thus rendered unusable by this approach. This unusable product was typically diverted down into a drain until sensors or human operators determine that the product flowing through the system was no longer diluted by rinse water. Then the full strength product was diverted back into the container filling system. In this invention, compressed FDA quality air or gas is used to evacuate the rinse water, creating a sterile buffer between the rinse water and the product. This approach entirely avoids the prior problem of product dilution by the initial rinse water in the system.

Because of the typical size of pumps used for pump 310, twenty or more gallons of water will often remain after water 302 is allowed to drain from pump 310. In order to thoroughly clear pump 310 of water, send compressed air/gas 305 through first check valve 306 for approximately at least 10 seconds at a flow rate approximately equivalent to 80 c.f.m. within a schedule 40 steel pipe having a nominal diameter of 2 inches, to push any remaining rinse water in product line 304 through and past pump 310 and second check valve 314.

Through second check valve 314, send compressed air/gas 312 for approximately at least two minutes (the actual time necessary is dictated by the size and length of product lines to be cleared) at a flow rate approximately equivalent to 80 c.f.m. within a schedule 40 steel pipe having a nominal diameter of 2 inches, through that portion of product line 304, to expel the remaining rinse water through sight glass 316, divert valve 318, product intake lines 202, 218, and 234, first divert valves 204, 220, and 236, and into bulk storage tank 206, blend tank 222, and line tank 238. After compressed air/gas 312 flow through these lines and equipment at an appropriate before rate and for an appropriate period of time based upon the size and length of product line 304, and product intake lines 202, 218, and 234, compressed air/gas 312 will have expelled all remaining water 302 into a bulk storage tank 206, blend tank 222, and line tank 238.

At this point in time product line 304, and all the equipment it interconnects, and product intake lines 202, 218, and 234, have been rinsed with water 312, and water 312 has been thoroughly evacuated by use of compressed air/gas 305 and compressed air/gas 312.

3. Product Recovery Module—Product Transfer Procedure

In order to begin transferring product through the product recovery module, product is introduced into product line 304 and into pump 310. Once pump 310 is primed with product, activate pump 310 to begin pumping product through product line 304 into product intake lines 202, 218, and 234, and into bulk storage tank 206, blend tank 222, and line tank 238. Pump 310 will continue to operate until there is insufficient product left to prime pump 310. At this stage of the process, that portion of product line 304 downstream from pump 310, and product intake lines 202, 218, and 234, and all the equipment those lines interconnect, are all fully charged with undiluted, usable product. Pump 310, however, is not able to continue pumping since it is no longer primed with product, and so the system must be cleared by another means.

4. Product Recovery Module—Product Recovery Procedure

Prior to the present invention, rinse water was used to push the remaining product through pump 310, product line 304 and product intake lines 202, 218, and 234, thus diluting a substantial quantity of the remaining product and rendering it unusable. This diluted product would then be dumped down a drain—a wasteful and costly approach.

In the present invention, the product remaining in pump 310, product line 304, and product intake lines 202, 218, and 234, is recovered using the air/gas evacuation approach. After pump 310 can no longer pump any further product down product line 304 and pump 310 has been deactivated, send compressed air/gas 305 through first check valve 306 for approximately at least 10 seconds at a flow rate approximately equivalent to 80 c.f.m. within a schedule 40 steel pipe having a nominal diameter of 2 inches, through product line 304, and pump 310 to push any remaining product through product line 304, and past pump 310, and past second check valve 314.

Immediately send compressed air/gas 312 through second check valve 314 for approximately at least 2 minutes at a flow rate approximately equivalent to 80 c.p.m. within a schedule 40 steel pipe having a nominal diameter of 2 inches, (the actual time and flow rate necessary is dictated by the size and length of product lines to be cleared) through product line 304, second check valve 314, sight glass 316, divert valve 318, product intake lines 202, 218, and 234, first divert valves 204, 220, and 236, into bulk storage tank 206, blend tank 222, and line tank 238. Before turning off the flow of compressed air/gas 312, utilize sight glass 316, or a suitable automatic sensory device, and verify that there is no product remaining in product line 304. Then wait for compressed air/gas 312 to expel the remaining product in intake lines 202, 218, and 234. With compressed air/gas 312 still flowing, turn off first divert valves 204, 220, and 236, and open divert valve 318 to product recovery module drain 320. At this point a very small amount of product residue is expelled into drain 320. Open first divert valves 204, 220, and 236, to bulk storage tank drain 210, blend tank drain 226, and line tank drain 242, and re-open divert valve 318 to product intake lines 202, 218, and 234. The remaining product residue will be expelled into drains 210, 226, and 242. Shut off the flow of compressed air/gas 312.

At the end of each product evacuation procedure, an optional rinse procedure may be performed. This is particularly useful if the filling line operator desires to switch from one product to another while the container line remains in substantially constant operation. If the optional rinse procedure is used at the end of each Product Recovery Procedure, then there may be no need to use the initial water rinse procedure prior to switching to and transferring a new product. This procedure, however, is at the filling line operator's discretion depending upon the types of products, regulatory requirements, or the customary practice of the particular filling plant.

The optional rinse procedure begins by sending water 302 through "T" valve 303, into product line 304 so that water 302 thoroughly rinses product line 304, first check valve 306, pump 310, second check valve 314, sight glass 316, and divert valve 318. Divert valve 318 is opened so that water 302 continues through product intake lines 202, 218, and 234, to first divert valves 204, 220, and 236. At this point in time, first divert valves 204, 220, and 236 remain open so that water 302 empties into drains 210, 226, and 242. Run water 302 through all of this equipment at a flow rate approximately equivalent to 80 g.p.m. within a schedule 40 steel pipe having a nominal diameter of 2 inches, for approximately 90 seconds. Discontinue the flow of the water 302 and allow the water to drain into drains 210, 226, and 242. Product line 304 and product intake lines 202, 218, 234 have now been rinsed clean.

C. Preferred components.

In one preferred embodiment of the product recovery modules, the following items have been used successfully, although other items which function in an equivalent manner can also be used:

| | |
|---|---|
| Water 302 | Approved government standards drinking water or approved process water. |
| Air/gas 305, 312 | For food and drug related applications of the present invention, Food and Drug Administration (FDA) grade sanitary air is preferably obtained by three stage Filenco Dryer/Filters to filter and dry high pressure compressed air on a point-of-use basis immediately prior to the introduction of the compressed air/gas to the check valves 306 and 314. Alternately, regular atmosphere air, or any inert or non-reactive gas, if filtered and dried properly, can be used for compressed air/gas 305 and 312 in non-food and non-drug applications of the present invention. |
| Check Valves 306, 312 | Tri-Clover 316 stainless steel ball check valve with Tri-Clover 316 stainless steel air/gas blow attachment. |
| Pump 310 | Tri Clover 316 stainless steel food grade sanitary pump. Both centrifical and positive displacement type pumps have been successfully utilized. |
| Product Line 304 | 316 stainless steel lines, approximately two inches in diameter. |
| Sight Glass 316 | Jensen 316 stainless steel sight glass. |
| Divert Valves 308, 318 | Tri Clover 316 stainless steel pneumatic divert valve or Tri Clover 316 stainless steel 3 way manual valve. |
| Product Intake Lines 202, 218, and 234 | 316 stainless steel lines, approximately two inches in diameter. |

III. Container filling line product recovery

The methods and apparatus for product recovery represented by this invention are not restricted to the recovery of product during a truck-to-tank transfer or a tank-to-tank transfer of product. This new invention can also be applied to the recovery of product from the product lines and equipment used in filling lines as well. This invention has been successfully tested on filling lines in three different configurations, which will be discussed below as Example I (Section A), Example 2 (Section B), and Example 3 (Section C). An additional example, Example 4 (Section D), embodies an improvement to the filing line recovery system described in Example 1.

A. EXAMPLE 1 (FIGS. 4, 2A AND 2)

1. Filler line rinse procedure

Using clean fresh safe balance tank spray ball water 406, pre-rinse a balance tank 403 and allow the rinse water to drain through a balance tank second valve 408, a balance tank first check valve 410, and a balance tank divert valve 411 into a balance tank drain 469. Using clean fresh filler feed tank spray ball water 431, pre-rinse a filler feed tank 430 and allow the rinse water to drain through a filler feed tank first check valve 434 and a filler feed tank divert valve 435 into a filler feed tank drain 436. Using clean, fresh, safe filler return tank spray ball water 449, pre-rinse a filler return tank 448, and allow the rinse water to drain through a filler return tank first check valve 453 and a filler return tank first divert valve 454 into a filler return tank drain 455.

Verify that the line tank valve second divert valve 246 (FIG. 2) is closed. Send water 302 (FIG. 3) through the product line 304 (FIG. 3) and all the equipment identified in the line tank product recovery module 248 (See FIGS. 2 and 3) and into the line tank product line 250 (FIG. 2), through a balance tank first valve 402, and into the balance tank 403. Fill the balance tank approximately 50% to 75% full, verifying the fill level by use of a balance tank sight glass 407 or other suitable automatic sensory device. Open the balance tank second valve 408 and allow water 302 to flood through a balance tank product line 401 into the balance tank first check valve 410, the balance tank divert valve 411, and into a balance tank pump 412, thus priming the balance tank pump. Activate the balance tank pump and pump water 302 forward into the following equipment interconnected by the balance tank product line 401: a balance tank second check valve 414; a balance tank "T" valve 415 (with optional source of water 472 attached); a pasteurizer/cooler 416; a pasteurizer/cooler R.T.D. sensor 419; a heat retention loop 420; zone heater/coolers 421; a zone heater/cooler R.T.D. sensor 424; a zone heater/cooler sight glass 425; a heat exchanger 426; a heat exchanger first divert valve 427 and into a filler feed tank 430. Continue pumping water 302 through the balance tank product line 401 until water 302 completely fills the filler feed tank 430. Water 302 then overflows through a filler feed tank overflow line 441 into a filler return tank 448. Open the filler feed tank first check valve 434 and allow water 302 to also flow through a filler feed tank product line 440 into a filler feed return tank divert valve 435 and into a filler feed tank pump 437, thus priming the filler feed tank pump. Activate the filler feed tank pump and pump water 302 through the filler feed tank product line 440 and into a filler feed tank second check valve 439, the heat exchanger 426, a filler R.T.D. sensor 442, a filler divert valve 443, and into a filler 445. Rinse the filler 445 for approximately ten seconds, then open the filler divert valve 443 so that the water 302 is diverted into a filler bypass product line 446, and then into a filler overflow product line 447, and then into the filler return tank 448.

Open a filler return tank first check valve 453 so that water 302 floods out through a filler return tank product line 451 into a filler return tank first divert valve 454, and into a filler return tank pump 456, thus priming the filler return tank pump. Turn a filler return tank 3-way switch 471 to the "on" position to activate the filler return tank pump and pump water 302 through the product line 451 into a filler return tank second check valve 458, a filler return tank second divert valve 459 open to a balance tank return product line 473, through a filler return tank third check valve 463, a balance tank heater/cooler 464, a balance tank heater/cooler sight glass 467, a balance tank heater/cooler divert valve 468, and into the balance tank 403. For approximately 15 seconds, open the filler return tank second divert valve 459 so that water 302 is diverted through a filler return tank second divert product line 460, a filler return tank second divert valve sight glass 461, and back into the filler feed tank 430. Reopen the return tank second divert valve 459 to send water 302 back through the balance tank return product line 473.

Turn off all system pumps, namely the balance tank pump 412, the filler feed tank pump 437, and the filler return tank pump 456. Open all divert-to-drain valves to their respective drains, namely the balance tank divert valve 411 to the balance tank drain 469, the heat exchanger first divert valve 427 to heat exchanger drain 429, the filler feed tank divert valve 435 to the filler feed tank drain 436, the filler return tank first divert valve 454 to the filler return tank drain 455, and the heater/cooler divert valve 468 to the balance tank drain 469.

2. Filler line rinse water air/gas evacuation procedure

In consecutive sequence, send compressed air/gas through each of the following check valves, preferably for approximately 30 seconds at a flow rate approximately equivalent to 80 c.f.m. within a schedule 40 steel pipe having a nominal diameter of 2 inches, or as required to thoroughly evacuate rinse water from the desired product lines and equipment:

a. Compressed air/gas 305 through check valve 306 (FIG. 3) in the line tank product recovery module 248 (FIG. 2).

b. Compressed air/gas 312 through check valve 314 (FIG. 3) in the line tank product recovery module 248 (FIG. 2).

c. Compressed air/gas 409 through the balance tank first check valve 410.

d. Compressed air/gas 413 through the balance tank second check valve 414.

e. Compressed air/gas 433 through the filler feed tank first check valve 434.

f. Compressed air/gas 438 through the filler feed tank second check valve 439.

g. Compressed air/gas 452 through the filler return tank first check valve 453.

h. Compressed air/gas 457 through the filler return tank second check valve 458 for approximately 45 seconds, making sure to open the filler return tank divert valve 459 for approximately 15 seconds to clear the product line 460 of rinse water.

i. Compressed air/gas 462 through the filler return tank third check valve 463.

The compressed air/gas flowing through all of the product lines, tanks, and equipment in the filler line in this fashion evacuates substantially all of the rinse water in the filler line. Now, when product flows through the filler line, substantially all of the product remains undiluted by residual rinse water and thus remains usable. No product is wasted in order to expel used rinse water from the filler line. At this stage of the process, the filler line is rinsed, the rinse water has been expelled, and the filler line is now ready for the introduction of product.

3. Filler line product transfer

Reopen all divert-to-drain valves to their respective product lines, namely the balance tank divert valve 411 to the product line 401, the heat exchanger first divert valve 427 to the product line 401, the filler feed tank divert valve 435 to the product line 440, the filler return tank first divert valve 454 to the product line 451, and the heater/cooler divert valve 468 to the balance tank return product line 473. Close the balance tank second valve 408. Open the line tank second valve 246 (FIG. 2) so that product flows into the line tank product line 250, and through product line 304 of the line tank product recovery module 248 (FIGS. 2 and 3) into the "T" valve 303 (FIG. 3), the first check valve 306 (FIG. 3), and into the pump 310, thus priming the pump 310 (FIG. 3).

Turn the balance tank 3-way switch 405 to the "auto" position, so that the switch responds to signal input 404*a* from the balance tank high/low probe 404. The high/low probe will signal the 3-way switch 405 to activate the line tank pump 310 if the product level in the balance tank 403 drops below a predetermined setting, and will signal the 3-way switch to turn the line tank pump off if the product level rises above a predetermined setting in the balance tank. Since the balance tank 403 is presently empty of both product and rinse water, turning the 3-way switch 405 to the "auto" position will activate the line tank pump 310 and fill the balance tank to a predetermined level.

Open the balance tank second valve 408 and allow product to flood through the balance tank product line 401 into the balance tank first check valve 410, the balance tank divert valve 411, and into the balance tank pump 412, thus priming the pump 412. Activate the pump 412 and pump product forward into the following equipment interconnected by the balance tank product line 401: the balance tank second check valve 414; the balance tank "T" valve 415 (with optional source of water 472 attached); the pasteurizer/cooler 416; the pasteurizer/cooler R.T.D. sensor 419; the heat retention loop 420; the zone heater/coolers 421; the zone heater/cooler R.T.D. sensor 424; the zone heater/cooler sight glass 425; the heat exchanger 426; the heat exchanger first divert valve 427 and into the filler feed tank 430. Open the filler feed tank first check valve 434 and allow product to flow through the filler feed tank product line 440 into the filler feed return tank divert valve 435 and into the filler feed tank pump 437, thus priming the pump 437.

Turn the heat exchanger 3-way switch 444 to the "auto" position, so that the switch responds to a signal input 442*a* from the filler R.T.D. sensor 442. The R.T.D. sensor will signal a filler 3-way switch 444 to activate the filler divert valve 443 to divert product to the filler bypass product line 446 if the product temperature is outside of a predetermined range of high and low temperature. Too low a temperature could render some products unsafe due to a lack of effective pasteurization. Too high a temperature could result in excessively hot product damaging plastic containers which may be used in some situations. For other products a cold temperature is desired. For example, carbonated beverages must be bottled at cold temperatures to maintain proper carbonation. The R.T.D. sensor will signal the filler 3-way switch 444 to activate the filler divert valve 443 to divert product to the filler 445 if the product temperature is within a predetermined range of high and low temperature, i.e. when the product is "at temperature." Since it takes several minutes for the product temperature to be adjusted to the proper level by the pasteurizer/cooler 416 and/or the zone heater/cooler 421, turning the filler 3-way switch 444 to the "auto" position at this time will activate the filler divert valve 443 to divert product to the filler bypass product line 446.

Activate the filler feed tank pump 437 and pump the product through the filler feed tank product line 440 and into the filler feed tank second check valve 439, the heat exchanger 426, the filler R.T.D. sensor 442, and to the filler divert valve 443. Product will flow into the filler bypass product line 446 until the R.T.D. sensor 442 senses that product temperature is within the predetermined range.

Until the product is "at temperature," it will continue to flow through the filler bypass product line 446, and then into the filler overflow product line 447, and then into the filler return tank 448. Open the filler return tank first check valve 453 so that product flows out through the filler return tank product line 451 into the filler return tank first divert valve 454, and into the filler return tank pump 456, thus priming the pump 456.

Turn the filler return tank 3-way switch 471 to the "auto" position, so that the switch responds to a signal input 470*a* from the balance tank high/low probe 470. The filler return high/low probe will signal the filler return tank 3-way switch 471 to send a signal input 471A to activate the filler return tank pump 456 when the product level in the filler return tank 448 rises to a predetermined level, and will signal the 3-way switch to turn the line tank pump off if the product level falls below a predetermined setting in the filler return tank. Since the filler return tank is presently filling with product, turning the 3-way switch 471 to the "auto" position will activate the filler return tank pump when the product in the filler return tank reaches the predetermined level in the tank. Once the filler return tank pump activates, the product is pumped through the product line 451 into the filler return tank second check valve 458, the filler return tank second divert valve 459 open to the balance tank return product line 473, the filler return tank third check valve 463, the balance tank heater/cooler 464, the balance tank heater/cooler sight glass 467, the balance tank heater/cooler divert valve 468 open to the balance tank return product line 473, and into the balance tank 403.

Balance tank product return line heater/cooler 464 is used to adjust the temperature of product being returned back into the balanced/filler feed tank. The heater/cooler adjusts the temperature of the product flowing through it by means of a balance tank product return line heater/cooler hot/cold service 465, which circulates service water through the heater/cooler by means of a balance tank product return line heater/cooler hot/cold service supply line 466. For those products which are placed into containers while warm or hot, the return line heater/cooler 464 is used is lower the temperature of the product returning to the balance tank 403 to approximately match the temperature of the product flowing into the balance tank from the line tank. For those products which are placed into containers while cool or cold, the return line heater/cooler is used is raise the temperature of the product returning to the balance tank to approximately match the temperature of the product flowing into the balance tank from the line tank.

Figure 4:
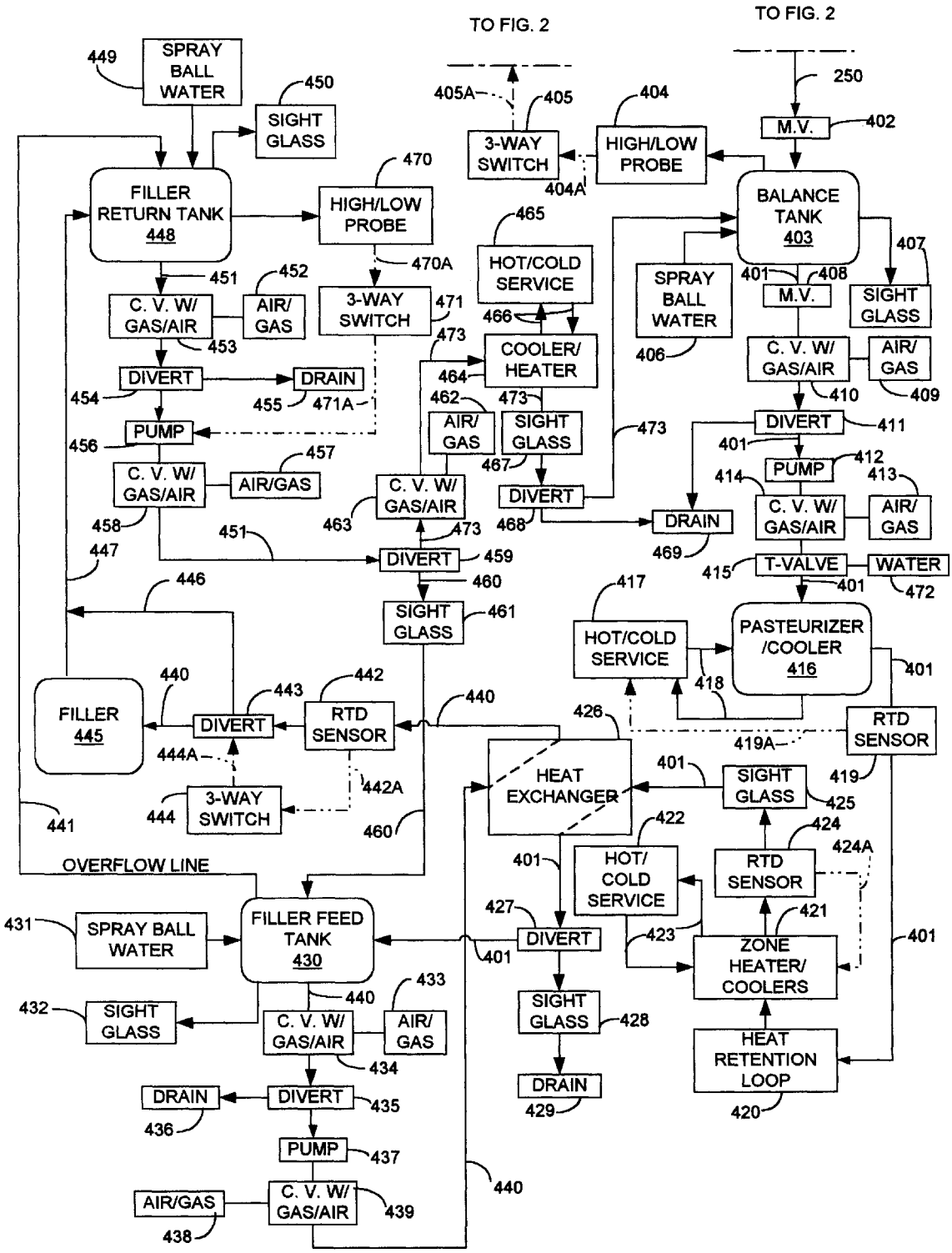
FIG. 4 is a schematic flow diagram of a preferred embodiment of the present invention showing a product recovery system which maintains substantially all of the product at a desired temperature during the entire product recovery process.

Product is now flowing completely through the filler line depicted in FIG. 4, except for the filler 445. Set the temperature at the controller (not shown) for hot/cold service 417. The pasteurizer/cooler 426 utilizes service water from the pasteurizer/cooler hot/cold service. This service water circulates through the pasteurizer/cooler by means of a pasteurizer/cooler service line 418, and is used to adjust the temperature of the product to the desired temperature. The pasteurizer/cooler R.T.D. sensor 419 senses the temperature of the product leaving the pasteurizer/cooler and sends a signal 419*a* back to the pasteurizer/cooler hot/cold service to automatically regulate the product temperature. The heat retention loop 420 is optionally used to help maintain the temperature of the product for an extended period of time after the product leaves the pasteurizer/cooler 416.

The zone heater/cooler 421 is used to adjust the temperature of the product after it has left the pasteurizer/cooler 416.

The zone heater/cooler utilizes service water from the zone heater/cooler hot/cold service 422. This service water circulates through the zone heater/cooler by means of a zone heater/cooler service supply lines 423, and is used to further adjust the temperature of the product to a desired temperature. The zone heater/cooler R.T.D. sensor 424 senses the temperature of the product leaving the pasteurizer/cooler and sends a signal 424*a* back to the zone heater/cooler hot/cold service 422 to automatically regulate the product temperature.

The heat exchanger 426 is utilized during this entire process to help preserve the desired product temperature. When the product reaches the proper temperature range (as set at the filler R.T.D. sensor 442), the filler divert valve 443 is automatically activated by the filler 3-way switch 444 to divert product into the filler 445.

Containers are now sent to the filler 445 and filled with product. This process continues until the end of the run, or until a product change.

4. Filler line product recovery procedure

Once the line tank goes empty, turn the balance tank 3-way switch 405 to the "off" position, thus turning off the line tank pump 310 in the line tank product recovery module 248 (See FIGS. 2 and 3). Send approximately 15 seconds of compressed air/gas 305 at a flow rate approximately equivalent to 80 c.f.m. within a schedule 40 steel pipe having a nominal diameter of 2 inches, through the check valve 306 (in line tank product recovery module 248) to evacuate substantially all the product from that portion of the product line 304 preceding the pump 310 and past the check valve 314. Send approximately 20 seconds of compressed air/gas 312 at a flow rate approximately equivalent to 80 c.f.m. within a schedule 40 steel pipe having a nominal diameter of 2 inches, through the check valve 314 (in line tank product recovery module 248) to evacuate the remainder of product from the product line 304, the line tank product line 250, and into the balance tank 403.

When the balance tank 403 is nearly empty of product (approximately 50 gallons remaining or at the filler operator's discretion), open the filler return tank second divert valve 459 to divert product into a filler return tank second divert valve product line 460, thus returning the product back into the filler feed tank 430. Send approximately 30 seconds of compressed air/gas 462 at a flow rate approximately equivalent to 80 c.f.m. within a schedule 40 steel pipe having a nominal diameter of 2 inches, through the filler return tank third check valve 463 to evacuate the remainder of product from the balance tank return product line 473, the balance tank heater/cooler 464, the balance tank heater/cooler sight glass 467, the balance tank heater/cooler divert valve 468, and into the balance tank 403.

When the balance tank 403 goes completely empty, turn the balance tank pump 412 off. Close the balance tank valve 408. Immediately send approximately 30 seconds of compressed air/gas 409 at a flow rate approximately equivalent to 80 c.f.m. within a schedule 40 steel pipe having a nominal diameter of 2 inches, through the balance tank first check valve 410 to evacuate the remainder of product from the balance tank product line 401, the balance tank divert valve 411, the balance tank pump 412, the balance tank second check valve 414, the balance tank "T" valve 415 (with optional source of water 472 attached); the pasteurizer/cooler 416; the pasteurizer/cooler R.T.D. sensor 419; the heat retention loop 420; the zone heater/coolers 421; the zone heater/cooler R.T.D. sensor 424; the zone heater/cooler sight glass 425; the heat exchanger 426; the heat exchanger first divert valve 427 and into the filler feed tank 430. The filler line operator should use the sight glass 425, or any other suitable sensor device, to verify that substantially all the product has been evacuated into the filler feed tank 430. Once this occurs, turn off the compressed air/gas 413 and close the balance tank second check valve 414. Immediately send water 472 into the balance tank "T" valve 415 and into the balance tank product line 401. Open the heat exchanger first divert valve 427 to the heat exchanger drain 429 via the heat exchanger sight glass 428.

Water 472 is now being heated or cooled to the desired temperature by the pasteurizer/cooler 416 and/or the zone heater/cooler 421. The temperature adjusted water 472 now becomes service water in the heat exchanger 426 to maintain or adjust the temperature of the remainder of product being circulated through the heat exchanger 426 and between the filler feed tank 430, the filler 445, and the filler return tank 448.

As the quantity of product becomes depleted, slow down the filler 445 and continue filling containers with product, which is maintained "at temperature" by circulating both product and temperature adjusted water 472 through the heat exchanger 426.

Continue slowing down the filler 445 and filling containers until the filler return tank 448 is empty, as verified by visual inspection of the filler return tank sight glass 450, or as verified by use of any other suitable sensory device. Turn the filler return tank 3-way switch 471 to the "off" position, thus deactivating the filler return pump 456. Send approximately 20 seconds of compressed compressed air/gas 452 at a flow rate approximately equivalent to 80 c.f.m. within a schedule 40 steel pipe having a nominal diameter of 2 inches, through the balance tank first check valve 453 to evacuate the remainder of product from the filler return tank product line 451, the filler return tank first divert valve 454, the filler return tank pump 456, the filler return tank second check valve 458, the filler return tank second divert valve 459, into the filler return tank second divert valve product line 460, through the filler return tank second divert valve sight glass 461, and into the filler feed tank 430.

Once the filler feed tank 430 is empty of product, turn off the filler feed tank pump 437. Send approximately 30 seconds of 15 to 20 p.s.i. compressed air/gas 433 through the filler feed tank first check valve 434 through the filler feed tank product line 440, the filler feed tank divert valve 435, the filler feed tank pump 437, the filler feed tank second check valve 439, the heat exchanger 426, the R.T.D. sensor 442, the filler divert valve 443 and into the filler 445. The use of temperature adjusted water 472 circulating through the heat exchanger 426 has maintained all the remaining evacuated product "at temperature" so that substantially all of the remaining product can be placed into containers at the filler 445 at approved temperature.

When the last container is filled, substantially all of the product originally introduced into the filler line has been placed into containers. Turn off the water 472. Turn the hot/cold service 417 off. Repeat the entire rinse procedure detailed in Section III.A.1 above, titled "Filler Line Rinse Procedure," and the entire air/gas evacuation procedure described above in Section III.A.2, titled, "Filler Line Rinse Water Air/Gas Evacuation Procedure." The filler line depicted in FIG. 4 is now ready for a product change, or ready to be shut down.

B. EXAMPLE 2 (FIGS. 5, 2B AND 2)

1. Filter line rinse procedure

Using balance/filler feed tank spray ball water 506, prerinse a balance/filler feed tank 503 and allow the rinse water to drain through a balance/filler feed tank second valve 508, a balance/filler feed tank first check valve 510, and a balance/filler feed tank divert valve 511 into a balance/filler feed tank drain 569. Using filler return tank spray ball water 549, pre-rinse a filler return tank 548, and allow the rinse water to drain through a filler return tank first check valve 553 and a filler return tank first divert valve 554 into a filler return tank drain 555.

Verify that the line tank second valve 246 (FIG. 2) is closed. Send water 302 (FIG. 3) through the product line 304 (FIG. 3), and all the equipment identified in line tank product recovery module 248 (See FIGS. 2 and 3), and into the line tank product line 250 (See FIGS. 2 and 3), through the balance/filler feed tank first valve 502, and into the balance/filler feed tank 503. Fill the balance/filler feed tank 503 approximately 50% to 75% fill, verifying the fill level by use of balance/filler feed tank sight glass 507, or alternately a suitable automatic sensory device. Open the balance/filler feed tank second valve 508 and allow the water 302 to flood through the balance/filler feed tank product line 501 into a balance/filler feed tank first check valve 510, a balance/filler feed tank divert valve 511, and into a balance/filler feed tank pump 512. The rinsing water 302 thus primes the pump 512. Activate the pump 512 and pump the water forward into the following equipment interconnected by balance/filter feed tank product line 501: a balance/filler feed tank second check valve 514, a balance/filler feed tank "T" valve 515, a pasteurizer/cooler 516, a pasteurizer/cooler R.T.D. sensor 519, a heat retention loop 520, a zone heater/cooler sight glass 525, a zone heater/coolers 521, a zone heater/cooler R.T.D. sensor 524, a heat exchanger first divert valve 527, a heat exchanger first check valve 529, a heat exchanger 526, a filter R.T.D. sensor 542, a filler divert valve 543 and into a filler 545.

Open the heat exchanger first divert valve 527, preferably for approximately 15 seconds or as required to perform an adequate rinse, to divert water 302 through a heat exchanger product line 541, a heat exchanger sight glass 528, the heat exchanger 526, a heat exchanger second divert valve 535, and into the filler return tank 548. After the heat exchanger product line 541, and the equipment it interconnects, have been thoroughly rinsed, open the heat exchanger first divert valve 527 to divert water 302 back into balance/filler feed tank product line 501.

Preferably for approximately 15 seconds, or as required to accomplish a thorough rinse, open a filler divert valve 543 so that the water 302 is diverted through a filler bypass product line 546 into a filler overflow product line 547, and into the filler return tank 548. Then, re-open filler divert valve to the filler 545.

Continue pumping the water 302 through the balance/filler feed tank product line 501, into the filler 545. As the water 302 floods through the filler 545, water 302 will continue to flow through the filler overflow product line 547 and into the filler return tank 548.

Open a filler return tank first check valve 553 so that the water 302 floods out through a filler return tank product line 551 into a filler return tank first divert valve 554, and into a filler return tank pump 556, thus priming the pump. Turn a filler return tank 3-way switch 571 from the "auto" position to the "on" position to activate the pump 556 and pump the water 302 through the product line 551 into a filler return tank second check valve 558, a filler return tank second divert valve 559, a balance/filler feed tank product return line 573, through a filler return tank third check valve 563, a balance/filler feed tank product return line heater/cooler 564, a heater/cooler sight glass 567, a balance/filler feed tank product return line heater/cooler divert valve 568, and to the balance/filler feed tank 503.

Preferably for approximately 15 seconds, or as required to accomplish a thorough rinse, open the filer return tank second divert valve 559 so that the water 302 is diverted through a filler return tank second divert product line 560 into a filler return tank second divert valve sight glass 561, a heat exchanger second check valve 574 and into the balance/filler feed tank product line 501.

Turn off all system pumps, namely the balance/filler feed tank pump 512 and the filler return tank pump 556. Open all divert-to-drain valves to their respective drains, namely the balance/filler feed tank divert valve 511 to the drain 569, the heat exchanger second divert valve 535 to a heat exchanger drain 536, the filler return tank first divert valve 554 to the drain 555, and the balance/filler feed tank product return line heater/cooler divert valve 568 to the drain 569. Allow the entire system to drain rinse water from the filler lines and equipment into the open drains.

2. Filler line rinse water air/gas evacuation procedure

In consecutive sequence, send compressed air/gas through the following check valves, preferably for approximately 30 seconds of at a flow rate approximately equivalent to 80 c.f.m. within a schedule 40 steel pipe having a nominal diameter of 2 inches, or as required to thoroughly evacuate all rinse water from the desired product lines and equipment:

a. Compressed air/gas 305 through product recovery module first check valve 306 (FIG. 3) in line tank produce recovery module 248 (FIG. 2).

b. Compressed air/gas 312 through product recovery module second check valve 314 (FIG. 3) in line tank produce recovery module 248 (FIG. 2).

c. Compressed air/gas 509 through balance/filler feed tank first check valve 510.

d. Compressed air/gas 513 through balance/filler feed tank second check valve 514.

e. Compressed air/gas 552 through filler return tank first check valve 553.

f. Compressed air/gas 557 through filler return tank second check valve 558, preferably for approximately 45 seconds total, including approximately 15 seconds with the filler return tank second divert valve 559 open to the product line 560 in order to clear the product line 560 of rinse water.

g. Compressed air/gas 562 through filler return tank third check valve 563.

Figure 5:
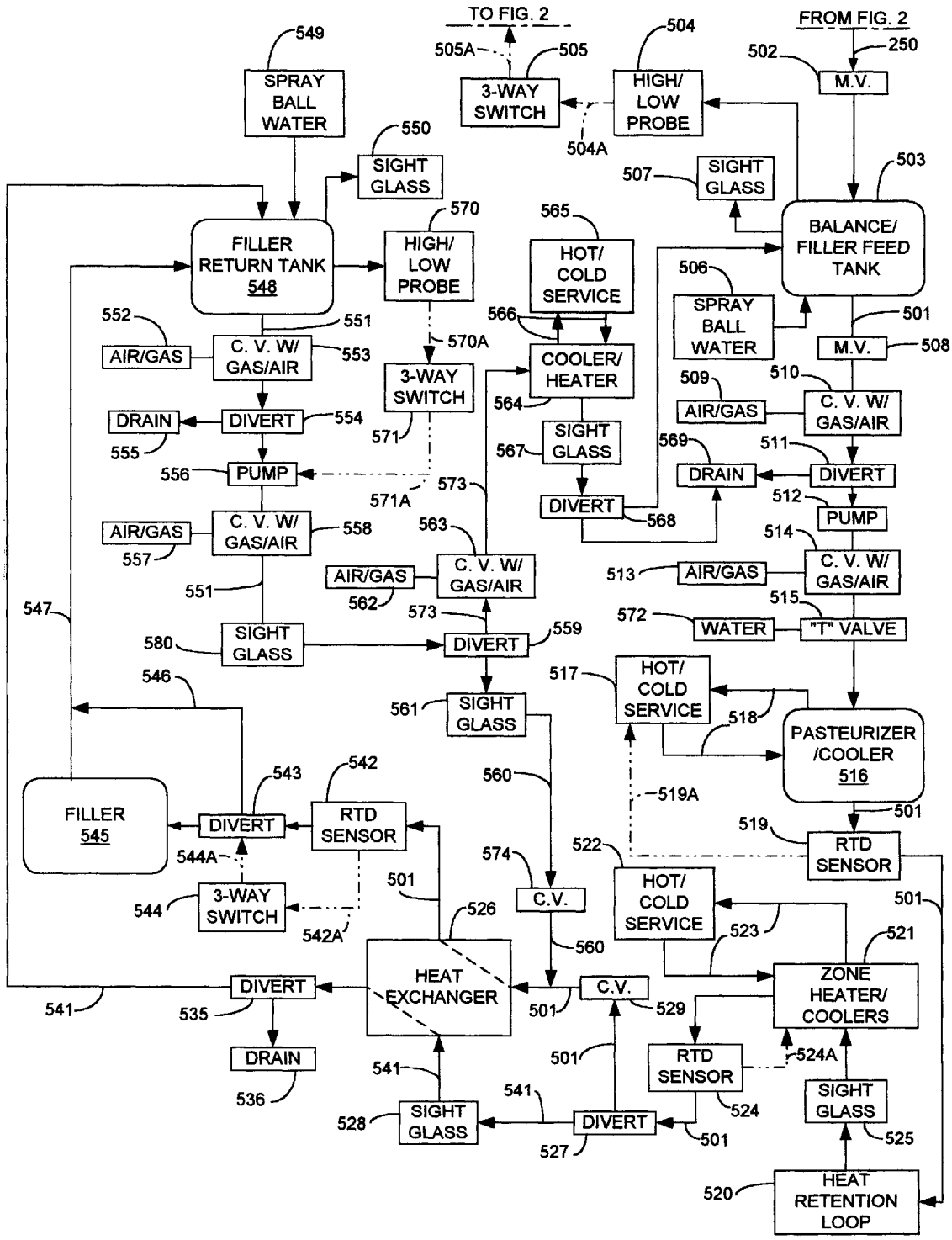
FIG. 5 is a schematic flow diagram of a preferred embodiment of the present invention showing a product recovery system which maintains substantially all of the product at a desired temperature during the entire product recovery process.

The compressed air/gas flowing through all of the product lines, tanks, and equipment in the filler line, as illustrated in FIGS. 2, 3, and 5, evacuates substantially all of the rinse water in the filler line. Thus, in the present invention, when product flows through the filler line, substantially all of the product remains undiluted by residual rinse water and therefore remains usable. No product is wasted m order to expel used rinse water from the filler line. At this stage of the process, the filler line is now rinsed, the rinse water has been expelled, and the filler line is ready for the introduction of the product from the line tank.

3. Filer line product transfer

Reopen all divert-to-drain valves to their respective product lines, namely the balance/filler feed tank divert valve 511 to the product line 501, the heat exchanger second divert valve 535 to the product line 540, the filler return tank first divert valve 554 to the product line 551, and the balance/ filler feed tank product return line heater/cooler divert valve 568 to the balance/filler feed tank return product line 573. Close the balance/filler feed tank second valve 508. Open the line tank second valve 246 (FIG. 2) so that the product flows into the line tank product line 250, and through the product line 304 of the line tank product recovery module 248 (FIGS. 2 and 3) into the "T" valve 303 (FIG. 3), the first check valve 306 (FIG. 3), and into the pump 310. The product thus primes the pump 310 (FIG. 3).

Turn a balance/filler feed tank 3-way switch 505 to the "auto" position, so that the switch responds to a signal input 504A from a balance/filler feed tank high/low probe 504. The high/low probe will signal the 3-way switch 505 to send a signal input 505A to line tank pump 310 (FIGS. 2 and 3) if the product level in the balance/filler feed tank 503 drops below a predetermined setting, and will signal the 3-way switch to turn the line tank pump off if the product level rises above a predetermined setting in the balance/filler feed tank. Since balance/filler feed tank 503 is presently empty of both product and rinse water, turning the 3-way switch 505 to the "auto" position will activate the line tank pump 310 and fill the balance/filler feed tank to a predetermined level.

Open the balance/filler feed tank second valve 508 and allow product to flood through the balance/filler feed tank product line 501 into the balance/filler feed tank first check valve 510, the balance/filler feed tank divert valve 511, and into the balance/filler feed tank pump 512, thus priming the pump 512. Activate the pump 512 and pump product forward into the following equipment interconnected by balance/filler feed tank product line 501: the balance/filler feed tank second check valve 514, balance/filler feed tank "T" valve 515, pasteurizer/cooler 516, pasteurizer/cooler R.T.D. sensor 519; heat retention loop 520, zone heater/cooler sight glass 525, zone heater/coolers 521, zone heater/cooler R.T.D. sensor 524, heat exchanger first divert valve 527, heat exchanger first check valve 529, heat exchanger 526, filler R.T.D. sensor 542, filler divert valve 543 (opened to filler bypass product line 546), filler bypass product line 546, return tank product intake line 547 and into the filler return tank 548.

Turn a heat exchanger 3-way switch 544 from the "off" position to the "auto" position, so that the switch responds to a signal input 542*a* from a filler R.T.D. sensor 542. The R.T.D. sensor will signal the 3-way switch 544 to send a signal input 544A to activate the filler divert valve 543 to divert product to the filler bypass product line 546 if the product temperature is outside of a predetermined range of high and low temperature. Too low a temperature could render some products unsafe due to a lack of effective pasteurization. Too high a temperature could result in excessively hot product damaging plastic containers which may be used in some situations. For other products a cold temperature is desired. For example, carbonated beverages must be bottled at cold temperatures to maintain proper carbonation. The R.T.D. sensor will signal the 3-way switch 544 to activate the filler divert valve 543 to divert product to the filler 545 if the product temperature is within a predetermined range of high and low temperature, i.e. when the product is "at temperature." Since it takes several minutes for the product temperature to be adjusted to the proper level by the pasteurizer/cooler 516 and/or the zone heater/cooler 521, turning the filler 3-way switch 544 to the "auto" position at this time will activate filler divert valve 543 to divert product to heat exchanger second divert product line 546.

Until the product is "at temperature," it will continue to flow through the filler bypass product line 546, and then into the filler overflow product line 547, and then into the filler return tank 548. Open the filler return tank first check valve 553 so that product flows out through the filler return tank product line 551 into the filler return tank first divert valve 554, and into the filler return tank pump 556, thus priming the pump.

Turn a return tank 3-way switch 571 to the "auto" position, so that the switch responds to a signal input 570*a* from a filler return tank high/low probe 570. The filler return high/low probe will signal the 3-way switch 571 to activate the filler return tank pump 556 when the product level in the filler return tank rises to a predetermined level, and will signal the 3-way switch to turn the line tank pump off if the product level falls below a predetermined setting in the filler return tank Since filler return tank is presently filling with product, turning the 3-way switch 505 to the "auto" position will activate the pump 556 when the product in the filler return tank reaches the predetermined level in the tank.

Once the pump 556 activates, the product is pumped through the filler return tank product line 551 into the filler return tank second check valve 558, the filler return tank second divert valve 559 (which is open to balance/filler feed tank return product line 573), the balance/filler feed tank return product line 573, the filler return tank third check valve 563, the balance/filler feed tank product return line heater/cooler 564, the balance/filer feed tank product return line heater/cooler sight glass 567, the balance/filler feed tank product return line divert valve 568, and into the balance/filler feed tank 503.

Balance/filler feed tank product return line heater/cooler 564 is used to adjust the temperature of product being returned back into the balance/filler feed tank 503. The heater/cooler adjusts the temperature of the product flowing through it by means of a balance/filler feed product return line heater/cooler hot/cold service 565, which circulates service water through the heater/cooler by means of a balance/filler feed product return line heater/cooler hot/cold service supply line 566. For those products which are placed into containers while warm or hot, the return line heater/cooler 564 is used is lower the temperature of the product returning to the balance/filler feed tank 503 to approximately match the temperature of the product flowing into the balance/filler feed tank from the line tank 238 (FIG. 2). For those products which are placed into containers while cool or cold, the return line heater/cooler is used is raise the temperature of the product returning to the balance/filler feed tank to approximately match the temperature of the product flowing into the balance/filler feed tank from the line tank.

Product is now flowing completely through the filler line depicted in FIG. 5, except for the filler 545. Set the temperature at the controller (not shown) for a pasteurizer/cooler hot/cold service 517. Pasteurizer/cooler utilizes service water from the pasteurizer/cooler hot/cold service 517. This service water circulates through the pasteurizer/cooler by means of a pasteurizer/cooler service supply line 518, and is used to adjust the temperature of the product to the desired temperature. The pasteurizer/cooler R.T.D. sensor 519 senses the temperature of the product leaving the pasteurizer/cooler and sends a signal 519*a* back to the hot/cold service 517 to automatically regulate the product temperature. The heat retention loop 520 is optionally used to help maintain the temperature of the product for an extended period of time after the product leaves the pasteurizer/cooler 516.

The zone heater/cooler 521 is used to adjust the temperature of the product after it has left the pasteurizer/cooler 516.

The zone heater/cooler utilizes service water from the zone heater/cooler hot/cold service 522. This service water circulates through the zone heater/cooler by means of a zone heater/cooler service supply lines 523, and is used to further adjust the temperature of the product to a desired temperature. The zone heater/cooler R.T.D. sensor 524 senses the temperature of the product leaving the pasteurizer/cooler and sends a signal 524A back to the zone heater/cooler hot/cold service 522 to automatically regulate the product temperature.

The heat exchanger 526 is utilized during his entire process to help preserve the desired product temperature. When the product reaches the proper temperature range (as set at the filler R.T.D. sensor 542), the filler divert valve 543 is automatically activated by the filler 3-way switch 544 to divert product into the filler 545.

Containers are now sent to filler 545 and filled with product. This process continues until the end of the run, or until a product change.

4. Filler line product recovery procedure

Once the line tank goes empty, turn the balance/filler feed tank 3-way switch 505 to the "off" position, thus turning off the line tank pump 310 in the line tank product recovery module 248 (See FIGS. 2 and 3). Send compressed air/gas 305 through the product recovery module first check valve 306 (in line tank product recovery module 248), preferably for approximately 15 seconds and at a flow rate approximately equivalent to 80 c.f.m. within a schedule 40 steel pipe having a nominal diameter of 2 inches, or as required to evacuate substantially all the product from that portion of the product line 304 preceding the pump 310 and to push the product past the product recovery module second check valve 314. Immediately send compressed air/gas 312 through the second check valve 314 (in line tank product recovery module 248), preferably for approximately 20 seconds at a flow rate approximately equivalent to 80 c.f.m. within a schedule 40 steel pipe having a nominal diameter of 2 inches, or as required to evacuate the remainder of product from the product line 304, line tank product line 250, and into the balance/filler feed tank 503.

When the balance/filler feed tank 503 is nearly empty of product (approximately 50 gallons remaining or at the filler operator's discretion), open the filler return tank second divert valve 559 to divert product through the filler return tank second divert valve product line 560, and through the heat exchanger second check valve 574 so that the product joins the product flowing through the balance/filler feed tank product line 501.

Send compressed air/gas 562 through filler return tank third check valve 563, a preferably for approximately 30 seconds at a flow rate approximately equivalent to 80 c.f.m. within a schedule 40 steel pipe having a nominal diameter of 2 inches, or as required to evacuate the remainder of product from the balance/filler feed tank product return line 573, the balance/filer feed tank product return line heater/cooler 564, the balance/filler feed tank product return line heater/cooler sight glass 567, the balance/filler feed tank product return line heater/cooler divert valve 568, and into the balance/filler feed tank 503.

When the balance/filler feed tank 503 goes completely empty, turn the balance/filler feed tank pump 512 off Close the balance/filler feed tank valve 508. Immediately send compressed air/gas 509 through balance/filler feed tank first check valve 510, preferably for approximately 30 seconds at a flow rate approximately equivalent to 80 c.f.m. within a schedule 40 steel pipe having a nominal diameter of 2 inches, or as required to evacuate the remainder of product from the balance/filler feed tank product line 501, the balance/filler feed tank divert valve 511, the balance/filler feed tank pump 512, the balance/filler feed tank second check valve 514, the balance/filler feed tank "T" valve 515, the pasteurizer/cooler 516, the pasteurizer/cooler R.T.D. sensor 519; the heat retention loop 520, the zone heater/cooler sight glass 525, the zone heater/coolers 521, the zone heater/cooler R.T.D. sensor 524, the heat exchanger first divert valve 527 (opened to heat exchanger product line 541), through the heat exchanger sight glass 528, into the heat exchanger 526, through the heat exchanger second divert valve 535, and into the filler return tank 548.

Using sight glass 528, or alternately an automatic senor device, verify that substantially all of the remaining product in the heat exchange product line 541 has been pushed into the filler return tank 548. Once this occurs, turn off compressed air/gas 513 and close the balance/filler feed tank second check valve 514. Immediately send water 572 through the balance/filler feed tank "T" valve 515 and into the balance/filler feed tank product line 501, preferably at a flow rate approximately equivalent to 60 g.p.m. within a schedule 40 steel pipe having a nominal diameter of 2 inches, within a schedule 40 steel pipe having a nominal diameter of 2 inches, within a schedule 40 steel pipe having a nominal diameter of 2 inches, or as required for the water 572 to simulate the flow of product through the pasteurizer/cooler 516 and heat exchanger 526. Open the heat exchanger second divert valve 535 to the heat exchanger drain 536.

The water 572 is now being heated or cooled to the desired temperature by the pasteurizer/cooler 516 and/or the zone heater/cooler 521. The temperature adjusted water 572 now becomes service water in the heat exchanger 526 to maintain or adjust the temperature of the remainder of product being circulated through the heat exchanger 526, filler 545 and filler return tank 548.

As the quantity of product becomes depleted, slow down the filler 545 and continue filling containers with product, which is maintained "at temperature" by circulating both product and the temperature adjusted water 572 through the heat exchanger 526.

Continue slowing down the filler 545 and filling containers until the filler return tank 548 is empty, as verified by use of the filler return tank sight glass 550, or alternately verified by use of a suitable automatic sensory device. Turn the filler return tank 3-way switch to the "off" position, thus deactivating the filler return pump 556. Send low volume air/gas 552 through the filler return tank first check valve 553, preferably at an approximate pressure of 15 to 20 p.s.i., or as required to evacuate the remainder of product from the filler return tank product line 551, filler return tank first divert valve 554, filler return tank pump 556, filler return tank second check valve 558, filler return tank second divert valve 559, into the filler return tank second divert valve product line 560, through the sight glass 561, and through the heat exchanger second check valve 574 into the balance/filler feed tank product line 501, then into the heat exchanger 526, filler R.T.D. sensor 542, filler divert valve 543, and into the filler 545. Use low volume air/gas 552 to continue pushing all remaining product through the system into the filler 545 and into the containers being filled.

The use of the temperature adjusted water 572 circulating through the heat exchanger 526 has maintained all the remaining evacuated product "at temperature" so that substantially all of the remaining product can be placed into containers at the filler 545 at approved temperature.

When the last container is filled, substantially all of the product originally introduced into the filler line has been placed into containers. Turn off water 572. Turn hot/cold service 517 off. Repeat the entire procedures detailed in Section III.B.1 above, titled "Filler Line Rinse Procedure," and in Section II.B.2, titled "Filler Line Rinse Water Air/Gas Evacuation Procedure." The filler line depicted in FIG. 5 is now ready for a product change, or ready to be shut down.

C. EXAMPLE 3 (FIGS. 6, 2C AND 2)

1. Filler line rinse procedure

Using balance/filler feed tank spray ball water 606, pre-rinse a balance/filler feed tank 603 and allow the rinse water to drain through a balance/filler feed tank second valve 608, a balance/filler feed tank first check valve 610, and a balance/filler feed tank divert valve 611 opened into a balance/filler feed tank drain 669. Using clean, fresh, safe filler return tank spray ball water 649, pre-rinse a filler return tank 648, and allow the rinse water to drain through a filler return tank first check valve 653 and a filler return tank first divert valve 654 into a filler return tank drain 655.

Verify that the line tank second valve 246 (FIG. 2) is closed. Send water 302 (FIG. 3) through the product line 304 (FIG. 3) and all the equipment identified in the line tank product recovery module 248 (See FIGS. 2 and 3) and into the line tank product line 250 (FIG. 2), through a balance/filler feed tank first valve 602, and into a balance/filler feed tank 603. Fill the balance/filler feed tank approximately 50% to 75% full, verifying the fill level by use of a balance/filler feed tank sight glass 607 or other suitable automatic sensory device. Open the balance/filler feed tank second valve 608 and allow water 302 to flood through a balance/filler feed tank product line 601 into the balance/filler feed tank first check valve 610, the balance/filler feed tank divert valve 611, and into a balance/filler feed tank pump 612, thus priming the balance/filler feed tank pump. Activate the balance/filler feed tank pump and pump water 302 forward into the following equipment interconnected by the balance/filler feed tank product line 601: a balance/filler feed tank second check valve 614, a balance/filler feed tank "T" valve 615, a pasteurizer/cooler 616, a pasteurizer/cooler R.T.D. sensor 619, a heat retention loop 620, a zone heater/cooler sight glass 625, zone heater/coolers 621, a zone heater/cooler R.T.D. sensor 624, a heat exchanger first check valve 629, a heat exchanger 626, a heat exchanger first R.T.D. sensor 628, a filler R.T.D. sensor 642, a filler divert valve 643 and into a filler 645.

For approximately 15 seconds open the filler divert valve 643 to divert water 302 into a filler bypass product line 646, which joins a filler overflow line 647 downstream from the filler 645, in order to rinse the filler bypass product line. Then reopen the filler divert valve to the filler. Continue pumping water 302 through the balance/filler feed tank product line 601 into the filler. As water 302 floods through the filler, water 302 will continue to flow through the filler overflow line 647 and into the filler return tank 648.

Open the filler return tank first check valve 653 so that water 302 floods out through a filler return tank product line 651 into the filler return tank first divert valve 654, and into a filler return tank pump 656, thus priming the filler return tank pump. Turn a filler return tank 3-way switch 671 to the "on" position to activate the filler return tank pump and pump water 302 through the product line 651 into a filler return tank second check valve 658, filler return tank sight glass 680, a filler return tank second divert valve 659 which is opened to a balance/filler feed tank return product line 673, through a filler return tank third check valve 663, a balance/filler feed tank product return line heater/cooler 664, a balance/filler feed tank product return line heater/cooler sight glass 667, a balance/filler feed tank product return line heater/cooler divert valve 668, and into the balance/filler feed tank 603.

For approximately 15 seconds, open the filler return tank second divert valve 659 so that water 302 is diverted through a filler return tank second divert product line 660, through a filler return tank second divert valve sight glass 661, a heat exchanger third check valve 675, and then into the balance/filler feed tank product line 601 at a point between the heat exchanger 626 and the heat exchanger first check valve 629. Then reopen the divert valve 659 to the balance/filler feed tank return product line 673.

Turn off all system pumps; namely, the balance/filler feed tank pump 612 and the filler return tank pump 656. Open all divert-to-drain valves to their respective drains; namely, the balance/filler feed tank divert valve 611 to the balance/filler feed tank drain 669, the filler return tank first divert valve 654 to the filler return tank drain 655, and the heater/cooler divert valve 668 to the balance/filler feed tank drain 669. Allow the entire system to drain as much rinse water as possible from the filler lines and equipment into the open drains. The entire filler line system is now rinsed.

2. Filler line rinse water compressed air/gas evacuation procedure

In consecutive sequence, send approximately 30 seconds of compressed air/gas at a flow rate approximately equivalent to 80 c.f.m. within a schedule 40 steel pipe having a nominal diameter of 2 inches, through each of the following check valves:

a. Compressed air/gas 305 through product recovery module first check valve 306 (FIG. 3) in the line tank produce recovery module 248 (FIG. 2).

b. Compressed air/gas 312 through product recovery module second check valve 314 (FIG. 3) in line tank produce recovery module 248 (FIG. 2).

c. Compressed air/gas 609 through the balance/filler feed tank first check valve 610.

d. Compressed air/gas 613 through the balance/filler feed tank second check valve 614 for approximately 45 seconds, making sure to open the filler divert valve 643 for approximately 15 seconds to clear the filler bypass product line 646 of rinse water.

e. Compressed air/gas 652 through the filler return thank first check valve 653.

f. Compressed air/gas 657 through the filler return tank second check valve 658 for approximately 45 seconds, making sure to open the divert valve 659 for approximately 15 seconds to clear the filler return second divert valve product line 660 of rinse water.

g. Compressed air/gas 662 through the filler return tank third check valve 663.

The compressed air/gas flowing through all of the product lines, tanks, and equipment in the filler line in this fashion evacuates substantially all of the rinse water in the filler line. Now, when product flows through the filler line, substantially all of the product remains undiluted by residual rinse water and thus remains usable. No product is wasted in order to expel used rinse water from the filler line. At this stage of the process, the filler line is now rinsed, the rinse water has been expelled, and the filler line is ready for the introduction of product.

3. Filler line product transfer

Reopen all divert-to-drain valves to their respective product lines; namely, the balance/filler feed tank divert valve 611 to the product line 601, the filler return tank first divert valve 654 to the product line 651, and the heater/cooler divert valve 668 to the balance/filler feed tank return product line 673. Close the balance/filler feed tank second valve 608.

Open the line tank second valve 246 (FIG. 2) so that product flows into the line tank product line 250, and through the product line 304 of the line tank product recovery module 248 (FIGS. 2 and 3) into the product recovery module "T" valve 303 (FIG. 3), the product recovery module first check valve 306 (FIG. 3), and into the product recovery module pump 310. Product thus primes the pump (FIG. 3).

Turn a balance/filler feed tank 3-way switch 605 to the "auto" position, so that the switch responds to a signal input 604*a* from a balance/filler feed tank high/low probe 604. The balance/filler feed tank high/low probe will signal the balance/filler feed tank 3-way switch to activate the line tank pump 310 if the product level in the balance/filler feed tank 603 drops below a predetermined setting, and will signal the balance/filler feed tank 3-way switch to turn the line tank pump off if the product level rises above a predetermined setting in the balance/filler feed tank. Since the balance/filler feed tank is presently empty of both product and rinse water, turning the balance/filler feed tank 3-way switch to the "auto" position will activate the line tank pump and fill the balance/filler feed tank to a predetermined level.

Open the balance/filler feed tank second valve 608 and allow product to flood through the balance/filler feed tank product line 601 into the balance/filler feed tank first check valve 610, the balance/filler feed tank divert valve 611, and into the balance/filler feed tank pump 612, thus priming the balance/filler feed tank pump. Activate the balance/filler feed tank pump and pump product forward into the following equipment interconnected by the balance/filler feed tank product line 601: the balance/filler feed tank second check valve 614, the balance/filler feed tank "T" valve 615, the pasteurizer/cooler 616, the pasteurizer/cooler R.T.D. sensor 619; the heat retention loop 620, the zone heater/cooler sight glass 625, zone heater/coolers 621, the zone heater/cooler R.T.D. sensor 624, the heat exchanger first check valve 629, the heat exchanger 626, the heat exchanger R.T.D. sensor 628, filler R.T.D. sensor 642, the filler divert valve 643 opened to the filler bypass product line 646, through the filler overflow line 647, and into the filler return tank 648.

Turn a filler 3-way switch 644 to the "auto" position, so that the switch responds to a signal input 642*a* from the filler R.T.D. sensor 642. The filler R.T.D. sensor will signal the filler 3-way switch to activate the filler divert valve 643 to divert product to the filler bypass product line 646 if the product temperature is outside of a predetermined range of high and low temperature. Too low a temperature could render some products unsafe due to a lack of effective pasteurization. Too high a temperature could result in excessively hot product damaging plastic containers which may be used in some situations. For other products a cold temperature is desired. For example, carbonated beverages must be bottled at cold temperatures to maintain proper carbonation. The filler R.T.D. sensor 642 will signal the filler 3-way switch 644 to activate the filler divert valve 643 (by means of the filler 3-way switch signal 644*a*) to divert product to the filler 645 if the product temperature is within a predetermined range of high and low temperature, i.e. when the product is "at temperature." Since it takes several minutes for the product temperature to be adjusted to the proper level by the pasteurizer/cooler 616 and/or the zone heater/cooler 621, turning the filler 3-way switch 644 to the "auto" position at this time will activate the filler divert valve to divert product to the filler bypass product line 646. Until the product is "at temperature," it will continue to flow through the heat exchanger second divert product line, and then into the filler overflow line 647, and then into the filler return tank 648. Open the filler return tank first check valve 653 so that product flows out through the filler return tank product line 651 into the filler return tank first divert valve 654, and into the filler return tank pump 656, thus priming the filler return tank pump.

Turn a filler return tank 3-way switch 671 to the "auto" position, so that the switch responds to a signal input 670*a* from a balance/filler feed tank high/low probe 670. The filler return high/low probe will signal the filler return tank 3-way switch to activate the filler return tank pump 656 when the product level in the filler return tank 648 rises to a predetermined level, and will signal the filler return tank 3-way switch to turn the line tank pump 310 off if the product level falls below a predetermined setting in the filler return tank. Since the filler return tank is presently filling with product, turning the balance/filler feed tank 3-way switch 605 to the "auto" position will activate the filler return tank pump 656 when the product in the filler return tank reaches the predetermined level in the tank. Once the filler return tank pump activates, the product is pumped through the product line 651 into the filler return tank second check valve 658, the filler return tank second divert valve 659 which is opened into the balance/filler feed tank return product line 673, the filler return tank third check valve 663, the heater/cooler 664, the heater/cooler sight glass 667, the heater/cooler divert valve 668 which is opened to the balance/filler feed tank return product line 673, and into the balance/filler feed tank 603.

Balance/filler feed tank product return line heater/cooler 664 is used to adjust the temperature of product being returned back into the balanced/filler feed tank. The heater/cooler adjusts the temperature of the product flowing through it by means of a balance/filler feed product return line heater/cooler hot/cold service 665, which circulates service water through the heater/cooler by means of a balance/filler feed product return line heater/cooler hot/cold service supply line 666. For those products which are placed into containers while warm or hot, the return line heater/cooler 664 is used is lower the temperature of the product returning to the balance/filler feed tank 603 to approximately match the temperature of the product flowing into the balance/filler feed tank from the line tank. For those products which are placed into containers while cool or cold, the return line heater/cooler is used is raise the temperature of the product returning to the balance/filler feed tank to approximately match the temperature of the product flowing into the balance/filler feed tank from the line tank.

Figure 6:
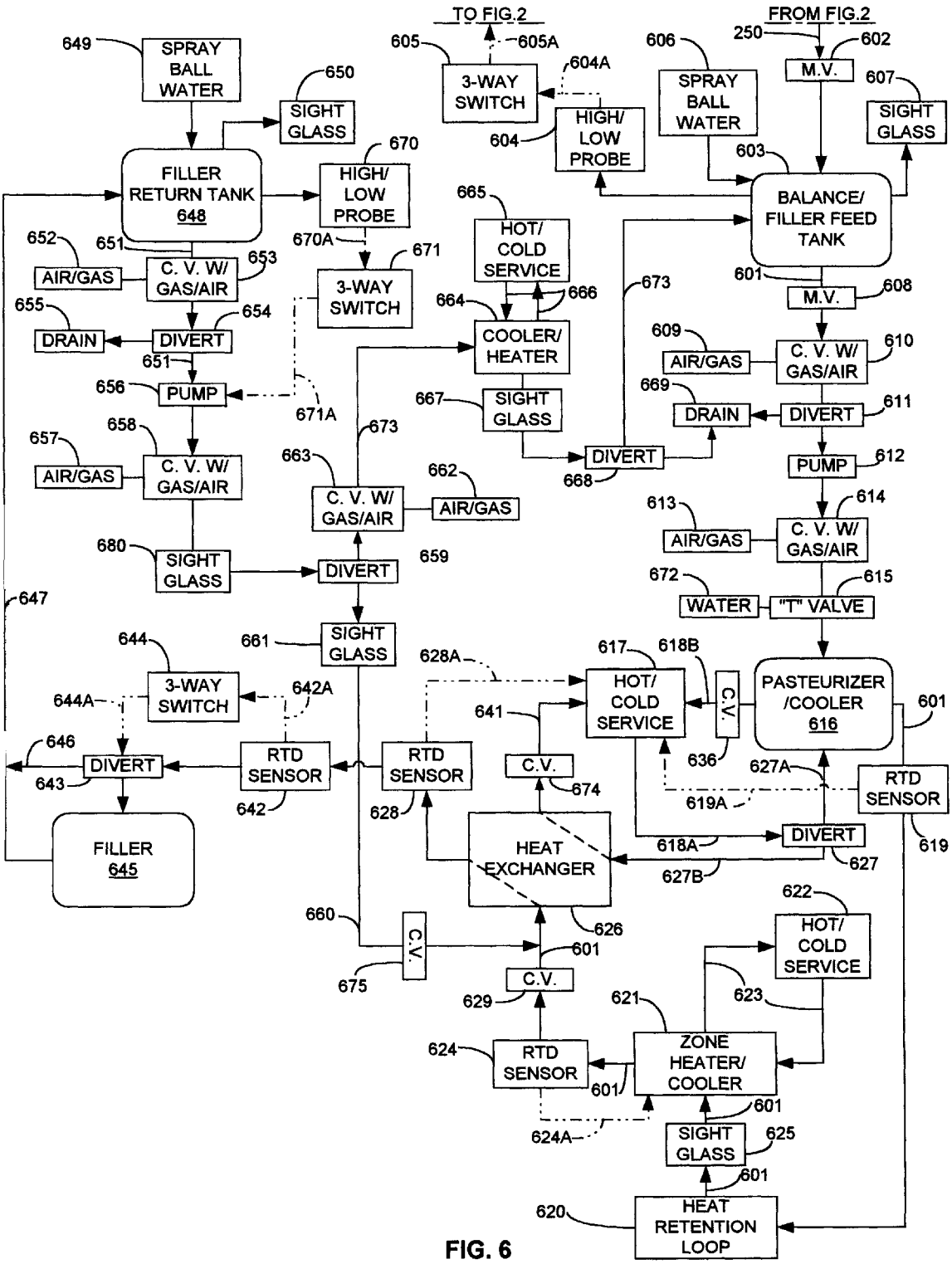
FIG. 6 is a schematic flow diagram of a preferred embodiment of the present invention showing a product recovery system which maintains substantially all of the product at a desired temperature during the entire product recovery process.

Product is now flowing completely through the filler line depicted in FIG. 6, except for the filler 645. Set the temperature at the controller (not shown) for the hot/cold service 617. The pasteurizer/cooler 616 utilizes service water from the hot/cold service. This service water circulates into the pasteurizer/cooler through a hot/cold service supply line 618*a*, a pasteurizer/cooler service divert valve 627, and a pasteurizer/cooler service intake line 627*a*, through the pasteurizer/cooler, and back to the hot/cold service by means of a pasteurizer/cooler service return line 618*b* and a pasteurizer/cooler check valve 636.

The service water supplied by the hot/cold service 617 through the pasteurizer/cooler 616 is used to adjust the temperature of the product to the desired temperature. The pasteurizer/cooler R.T.D. sensor 619 senses the temperature of the product leaving the pasteurizer/cooler and sends a signal 619*a* back to the hot/cold service to automatically regulate the product temperature at the desired setting. The heat retention loop 620 is optionally used to help maintain the temperature of the product for an extended period of time after the product leaves the pasteurizer/cooler 616.

The zone heater/cooler 621 is used to adjust the temperature of the product after it has left the pasteurizer/cooler 616. The zone heater/cooler utilizes service water from the zone heater/cooler hot/cold service 622. This service water circulates through the zone heater/cooler by means of a zone heater/cooler service supply lines 623, and is used to further adjust the temperature of the product to a desired temperature. The zone heater/cooler R.T.D. sensor 624 senses the temperature of the product leaving the pasteurizer/cooler and sends a signal 624*a* back to the zone heater/cooler hot/cold service 622 to automatically regulate the product temperature.

The heat exchanger 626 is utilized during this entire process to help preserve the desired product temperature. When the product reaches the proper temperature range (as set at filler R.T.D. sensor 642), the filler 3-way switch 644 sends a signal 644*a* to the filler divert valve 643 to divert product into the filler 645.

Containers are now sent to the filler 645 and filled with product. This process continues until the end of the run, or until a product change.

4. Filler line product recovery procedure

Once the line tank goes empty, turn the balance/filler feed tank 3-way switch 605 to the "off" position, thus turning off the line tank pump 310 in the line tank product recovery module 248 (See FIGS. 2 and 3). Send approximately 15 seconds of compressed air/gas 305 at a flow rate approximately equivalent to 80 c.f.m. within a schedule 40 steel pipe having a nominal diameter of 2 inches, through the product recovery module first check valve 306 (in line tank product recovery module 248) to evacuate substantially all the product from that portion of the product line 304 preceding the product recovery module pump 310 and past the second check valve 314. Send approximately 20 seconds of compressed air/gas 312 at a flow rate approximately equivalent to 80 c.f.m. within a schedule 40 steel pipe having a nominal diameter of 2 inches, through the product recovery module second check valve 314 (in line tank product recovery module 248) to evacuate the remainder of product from the product line 304, the line tank product line 250, and into the balance/filler feed tank 603.

When the balance/filler feed tank 603 is nearly empty of product (approximately 50 gallons remaining or at the filler operator's discretion), slow down the balance/filler feed tank pump 612. Also slow down the filler return tank pump 656, and open the filler return tank second divert valve 659 to divert product through the filler return tank second divert valve product line 660, so that the product joins the product flowing through the balance/filler feed tank product line 601 at a point between the heat exchanger check valve 629 and the heat exchanger 626.

Send approximately 30 seconds of compressed air/gas 662 at a flow rate approximately equivalent to 80 c.f.m. within a schedule 40 steel pipe having a nominal diameter of 2 inches, through the filler return tank third check valve 663 to evacuate the remainder of product from the balance/filler feed tank return product line 673, the heater/cooler 664, the heater/cooler sight glass 667, the heater/cooler divert valve 668, and into the balance/filler feed tank 603.

When the balance/filler feed tank 603 goes completely empty, turn off the balance/filler feed tank pump 612. Close the balance/filler feed tank second valve 608.

Open the pasteurizer/cooler divert valve 627 to a heat exchanger service intake line 627*b*. Direct service water from the hot/cold service 617 through a hot/cold service supply line 618*a*, the pasteurizer/cooler divert valve 627, the heat exchanger service intake line 627*b*, and into the heat exchanger 626. The service water circulates through heat exchanger and then returns to the hot/cold service through a heat exchanger service return line 641 and heat exchanger second check valve 674. At this point, the hot/cold service is solely servicing the heat exchanger 626, and not the pasteurizer/cooler 619. The heat exchanger is now used to maintain or adjust the temperature of the product to the desired setting while all of the remaining product in the filler line is pumped or evacuated into the filler 645 and placed into containers.

Temporarily stop sending containers to the filler 645. Open the filler divert valve 643 to the filler bypass line 646. Send approximately 10 seconds of compressed air/gas 609 at a flow rate approximately equivalent to 80 c.f.m. within a schedule 40 steel pipe having a nominal diameter of 2 inches, through the balance/filler feed tank first check valve 610 to evacuate the residual product forward through the product line 601, the divert valve 611, and the balance/filler feed tank pump 612, and past the balance/feed filler tank check valve 614. Immediately send approximately 60 seconds of compressed air/gas 613 at a flow rate approximately equivalent to 80 c.f.m. within a schedule 40 steel pipe having a nominal diameter of 2 inches, through the balance/filer feed tank first check valve 614 to evacuate the remainder of product from the balance/filler feed tank product line 601, the balance/filler feed tank "T" valve 615, the pasteurizer/cooler 616, the pasteurizer/cooler R.T.D. sensor 619; the heat retention loop 620, the zone heater/cooler sight glass 625, zone heater/coolers 621, the zone heater/cooler R.T.D. sensor 624, the heat exchanger first check valve 629, and into the heat exchanger 626.

Set the filler 3-way switch 644 back to "auto" so that product is diverted back into the filler 645 once the product returns to "temperature." Once product begins flowing back into the filler, restart the filler at a slow speed and restart sending containers to the filler. The filler return tank pump 656 is now acting as the container filler feed pump, and the filler return tank 648 is functioning as both the filler return tank and the filler feed tank. As the total quantity of product becomes depleted, slow down the filler 645 as necessary and continue filling containers with product, which is being maintained "at temperature" by circulating both product and service water through the heat exchanger 626.

Continue slowing down the filler 645 and filling containers until the filler return tank 648 is empty, as verified by use of the filler return tank sight glass 650, or alternately verified by use of any other suitable sensory device. Turn the filler return tank 3-way switch 671 to the "off" position, thus deactivating the filler return pump 656. Send low volume compressed air/gas 652, at an approximate flow rate of 15 to 20 p.s.i. through the filler return tank first check valve 653 to evacuate the remainder of product through the filler return tank product line 651, the filler return tank first divert valve 654, the filler return tank pump 656, the filler return tank second check valve 658, the filler return tank second divert valve 659, the filler return tank second divert valve product line 660, the heat exchanger sight glass 661, the heat exchanger third check valve 675, the balance/feed tank product line 601, the heat exchanger 626, the heat exchanger R.T.D. sensor 628, the filler R.T.D. sensor 642, the filler divert valve 643, and into the filler 645. Use low pressure compressed air/gas 652 to continue pushing all remaining product through the system into the filler 645 and into the containers being filled.

The use of temperature adjusted service water diverted by pasteurizer/cooler service divert valve 627 to circulate through the heat exchanger 626 has maintained all the remaining evacuated product "at temperature" so that substantially all of the remaining product can be placed into containers at the filler 645 at approved temperature.

When the last container is filled, substantially all of the product originally introduced into the filler line has been placed into containers. Turn off the hot/cold service 617. Repeat the entire rinse procedure described in Section III.C.1 above, titled "Filler Line Rinse Procedure," and the rinse water air/gas evacuation procedure described in section III.C.2. above, titled, "Filler Line Rinse Water Air/Gas Evacuation Procedure." The filler line depicted in FIG. 6 is now ready for a product change, or ready to be shut down.

D. EXAMPLE 4 (FIGS. 7, 2D 2)

1. Filler line rinse procedure

Using balance tank spray ball water 706, pre-rinse a balance tank 703 and allow the rinse water to drain through a balance tank second valve 708, a balance tank first check valve 710, and a balance tank divert valve 711 into a balance tank drain 769. Using filler feed tank spray ball water 731, pre-rinse a filler feed tank 730 and allow the rinse water to drain through a filler feed tank first check valve 734 and a filler feed tank divert valve 735 into a filler feed tank drain 736. Using filler return tank spray ball water 749, pre-rinse a filler return tank 748, and allow the rinse water to drain through a filler return tank first check valve 753 and a filler return tank first divert valve 754 into a filler return tank drain 755.

Verify that the line tank valve second 246 (FIG. 2) is closed. Send water 302 (FIG. 3) through the product line 304 (FIG. 3) and all the equipment identified in the line tank product recovery module 248 (See FIGS. 2 and 3) and into the line tank product line 250 (FIG. 2), through the balance tank first divert valve 702, and into the balance tank 703. Fill the balance tank 703 approximately 50% to 75% full, verifying the fill level by use of a balance tank sight glass 707, or alternately a suitable automatic sensory device. Open the balance tank first valve 708 and allow water 302 to flood through the balance tank product line 701 into a balance tank first check valve 710, a balance tank divert valve 711, and into a balance tank pump 712. The rinsing water 302 thus primes the balance tank pump.

Activate the balance tank pump 712 and pump water 302 forward into the following equipment interconnected by the balance tank product line 701: a balance tank second check valve 714; a balance tank "T" valve 715; a pasteurizer/cooler 716; a pasteurizer/cooler R.T.D. sensor 719; a heat retention loop 720; zone heater/coolers 721; a zone heater/cooler R.T.D. sensor 724; a zone heater/cooler sight glass 725; a zone heater/cooler divert valve 727, and into the filler feed tank 730. Continue pumping water 302 through the balance tank product line 701 until water completely fills the filler feed tank 730.

Water 302 then overflows through a filler feed tank overflow line 741 into a filler return tank 748. Water 302 also flows through a filler feed tank first check valve 734 through a filler feed tank product line 740 into a filler feed first check valve 734, a filler feed tank first divert valve 735, and then into a filler feed tank pump 737, thus priming the filler feed tank pump. Activate the filler feed tank pump and pump water 302 through the filler feed tank product line 740 and into a filler feed tank second check valve 739, a filler feed tank second divert valve 784, a filler feed tank third check valve 785, a filler product line 787, a filler R.T.D. sensor 742, a filler divert valve 743, and into a filler 745. Preferably, rinse the filler 745 for approximately 10 seconds, then open the filler divert valve 743 so that water 302 is diverted into a filler bypass product line 746, then into a filler overflow return line 747, and then into the filler return tank 748. Open the filler feed tank second divert valve 784 to divert water 302 into a blowdown line 786 and the filler return tank 748 for preferably approximately 10 seconds to rinse out the blowdown line 786. Once the blowdown line 786 has been rinsed, re-open the second divert valve 784 to divert water 302 back into the filler feed tank product line 740.

Water 302 flows through a filler return tank first check valve 753 into a filler return tank product line 751, through a filler return tank first check valve 753, a filler return tank first divert valve 754, and into a filler return tank pump 756, thus priming the filler return pump. Turn a filler return tank 3-way switch 771 to the "on" position to activate the filler return tank pump and pump water 302 through the product line 751 into a filler return tank second check valve 758, a filler return tank second divert valve 759 (open to a balance tank product return line 773), through the balance tank product return line 773, a filler return tank third check valve 763, a balance tank product return line heater/cooler 764, a balance tank product return line heater/cooler sight glass 767, a balance tank product return line heater/cooler divert valve 768, and into the balance tank 703.

Preferably for approximately 15 seconds, open the filler return tank second divert valve 759 so that water 302 is diverted through a heat exchanger product line 760, a heat exchanger sight glass 761, the heat exchanger 726, a filler product line 787, a heat exchanger R.T.D. sensor 788, a filler check valve 789, the filler R.T.D. sensor 742, the filler divert valve 743, and into the filler 745. Then, re-open the filler return tank third divert valve 759 to send water 302 back through the balance tank product return line 773 to complete rinsing the product line 773 and the equipment it interconnects.

Turn of fall system pumps; namely, the balance tank pump 712, the filler feed tank pump 737, and the filler return tank pump 756. Open all divert-to-drain valves to their respective drains; namely, the balance tank divert valve 711 to the balance tank drain 769, the zone heater/cooler divert valve 727 to a zone heater/cooler drain 729, filler feed tank divert valve 735 to the filler feed tank drain 736, the filler return tank first divert valve 754 to the filler return tank drain 755, and balance tank product return line heater/cooler divert valve 768 to balance tank drain 769. The entire filler line system is now rinsed.

2. Filler line rinse water air/gas evacuation procedure

In consecutive sequence, send approximately 30 seconds of compressed air/gas at a flow rate approximately equivalent to 80 c.f.m. within a schedule 40 steel pipe having a nominal diameter of 2 inches, through each of the following check valves:

a. Compressed air/gas 305 through the product recovery module first check valve 306 (FIG. 3) in the line tank produce recovery module 248 (FIG. 2).

b. Compressed air/gas 312 through the product recovery module second check valve 314 (FIG. 3) in the line tank produce recovery module 248 (FIG. 2).

c. Compressed air/gas 709 through the balance tank first check valve 710.

d. Compressed air/gas 713 through the balance tank second check valve 714.

e. Compressed air/gas 733 through the filler feed tank first check valve 734.

f. Compressed air/gas 738 through the filler feed tank second check valve 739 for approximately 60 seconds, making sure to open the filler feed tank second divert valve 784 for approximately 15 seconds to clear the blowdown line 786 of rinse water, and to open the filler divert valve 743 for approximately 15 seconds to clear the filler bypass line 746 and the filler overflow return line 747 of rinse water.

g. Compressed air/gas 752 through the filler return tank first check valve 753.

h. Compressed air/gas 757 through the filler return tank second check valve 758 for at least approximately 45 seconds, making sure to open the third divert valve 759 for at least approximately 15 seconds to clear the heat exchanger product line 760, the heat exchanger 726, and the filler product line 787 of rinse water.

i. Compressed air/gas 762 through filler return tank third check valve 763.

The compressed air/gas flowing through all of the product lines, tanks, and equipment in the filler line in this fashion evacuates substantially all of the rinse water in the entire filler line. Now, when product flows through the filler line, substantially all of the product remains undiluted by residual rinse water and thus remains usable. No product is wasted in order to expel used rinse water from the filler line. At this stage of the process, the filler line is now rinsed, the rinse water is expelled, and the filler line is ready for the introduction of product.

3. Filler line product transfer

Reopen all divert-to-drain valves to their respective product lines, namely the balance tank divert valve 711 to the balance tank product line 701, the zone heater/cooler divert valve 727 to the product line 701, the filler feed tank first divert valve 735 to the filler feed tank product line 740, the filler feed tank second divert valve 784 to the product line 740, the filler divert valve 743 to the filler product line 787, the filler return tank first divert 754 to the filler return tank product line 751, and the balance tank heater/cooler divert valve 768 to the balance tank return product line 773. Close the balance tank first valve 708. Open the line tank second valve 246 (FIG. 2) so that product flows into the line tank product line 250, and through the product line 304 of the line tank product recovery module 248 (FIGS. 2 and 3) into the product recovery module "T" valve 303 (FIG. 3), the product recovery module first check valve 306 (FIG. 3), and into the product recovery module pump 310. The product thus primes the product recovery module pump 310 (FIG. 3).

Turn a balance tank 3-way switch 705 to the "auto" position, so that the switch responds to a signal input 704*a* from a balance tank high/low probe 704. The high/low probe will signal the 3-way switch 705 to activate the line tank pump 310 if the product level in the balance tank 703 drops below a predetermined setting, and will signal the 3-way switch to turn the line tank pump off if the product level rises above a predetermined setting in the balance tank. Since the balance tank 703 is presently empty of both product and rinse water, turning the 3-way switch 705 to the "auto" position will activate the line tank pump 310 and fill the balance tank to a predetermined level.

Open the balance tank first valve 708 and allow product to flood through the balance tank product line 701 into the balance tank first check valve 710, the balance tank divert valve 711, and into the balance tank pump 712, thus priming pump 712. Activate pump 712 and pump product forward into the following equipment interconnected by the balance tank product line 701: the balance tank second check valve 714; the balance tank second valve 715; the pasteurizer/cooler 716; the pasteurizer/cooler R.T.D. sensor 719; the heat retention loop 720; the zone heater/coolers 721; the zone heater/cooler R.T.D. sensor 724; the zone heater/cooler sight glass 725; the zone heater/cooler divert valve 727, and into the filler feed tank 730. Product will then flow through the filler feed tank product line 740, the filler feed tank first check valve 734, the filler feed return tank first divert valve 735, and into the filler feed tank pump 737, thus priming the pump 737.

Turn a filler 3-way switch 744 to the "auto" position, so that the switch responds to a signal input 742*a* from filler R.T.D. sensor 742. The R.T.D. sensor will signal the 3-way switch 744 to send a filler 3-way-switch signal 744*a* to activate the divert valve 743 to divert product to the filler bypass product line 746 if the product temperature is outside of a predetermined range of high and low temperature. Too low a temperature could render some products unsafe due to a lack of effective pasteurization. Too high a temperature could result in excessively hot product damaging plastic containers which may be used in some situations. For other products a cold temperature is desired. For example, carbonated beverages must be bottled at cold temperatures to maintain proper carbonation. The filler R.T.D. sensor 742 will signal the filler 3-way switch 744 to activate the filler divert valve 743 to divert product to the filler 745 if the product temperature is within a predetermined range of high and low temperature, i.e. when the product is "at temperature." Since it takes several minutes for the product temperature to be adjusted to the proper level by the pasteurizer/cooler 716 and/or the zone heater/cooler 721, turning the filler 3-way switch 744 to the "auto" position at this time will activate the filler divert valve 743 to divert product to the filler bypass product line 746.

Activate the pump 737 and pump the product through the filler feed tank product line 740 and into the filler feed tank second check valve 739, the filler feed tank second divert valve 784, the filler feed tank third check valve 785, the filler product line 787, the filler R.T.D. sensor 742, the filler divert valve 743, and into the filler bypass line 746. Product will continue to flow into the filler bypass line 746 until the filler R.T.D. sensor 742 senses that product temperature is within the predetermined range, or "at temperature." The process of adjusting the product temperature takes some time.

Until the product is "at temperature," it will continue to flow through the filler bypass product line 746, and then into the filler overflow product line 747, and then into the filler return tank 748. Product will then flow into the filler return tank product line 751, through the filler return tank first check valve 753, the filler return tank first divert valve 754, and into the filler return tank pump 756, thus priming pump 756.

Turn a filler return tank 3-way switch 771 to the "auto" position, so that the switch responds to a filler return tank high/low probe signal input 770*a* from a filler return tank high/low probe 770. The filler return high/low probe will signal the 3-way switch 771 to send a filler return tank 3-way switch signal 771*a* to activate the filler return tank pump 756 when the product level in the filler return tank rises to a predetermined level, and will signal the filler return tank 3-way switch to turn the filler return tank pump 756 off if the product level falls below a predetermined setting in the filler return tank 748. Since filler return tank is presently filling with product, turning the filler return tank 3-way switch 705 to the "auto" position at this stage of the process will activate the pump 756 when the product in the filler return tank 748 reaches the predetermined level in the tank.

Once the pump 756 activates, the product is pumped through the product line 751 into the filler return tank second check valve 758, the filler return tank second divert valve 759 (open to the balance tank product return line 773), the balance tank product return line 773, the filler return tank third check valve 763, the balance tank product return line heater/cooler 764, the balance tank heater/cooler sight glass 767, the balance tank heater/cooler divert valve 768, and into the balance tank 703.

Balance/filler feed tank product return line heater/cooler 764 is used to adjust the temperature of product being returned back into the balanced/filter feed tank. The heater/cooler adjusts the temperature of the product flowing through it by means of a balance/filler feed product return line heater/cooler hot/cold service 765, which circulates service water through the heater/cooler by means of a balance/filler feed product return line heater/cooler hot/cold service supply line 766. For those products which are placed into containers while warm or hot, the return line heater/cooler 764 is used is lower the temperature of the product returning to the balance/filler feed tank 703 to approximately match the temperature of the product flowing into the balance/filler feed tank from the line tank. For those products which are placed into containers while cool or cold, the return line heater/cooler is used is raise the temperature of the product returning to the balance/filler feed tank to approximately match the temperature of the product flowing into the balance/filler feed tank from the line tank.

Figure 7:
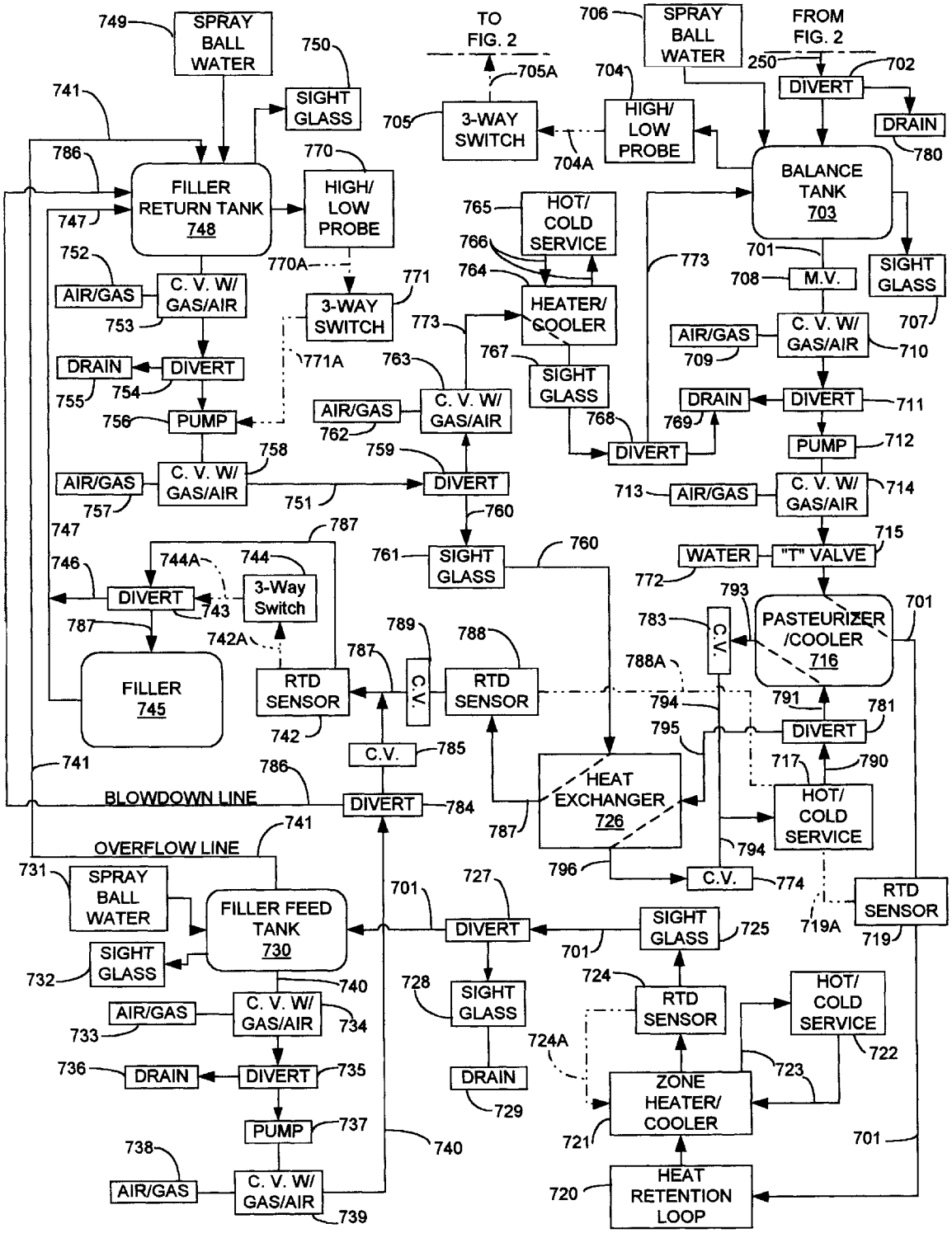
FIG. 7 is a schematic flow diagram of a preferred embodiment of the present invention showing a product recovery system which maintains substantially all of the product at a desired temperature during the entire product recovery process.

Product is now flowing completely through the entire filler line depicted in FIG. 7, except for the filler 745. Set the temperature at the controller (not shown) for a pasteurizer/cooler hot/cold service 717. The Pasteurizer/cooler 716 utilizes service water from the pasteurizer/cooler hot/cold service 717. While product is flowing through the pasteurizer/cooler 716, the service water from the hot/cold service 717 is diverted by a pasteurizer/cooler divert valve 781 to flow through the pasteurizer/cooler 716 through the following product lines and equipment: a pasteurizer/cooler hot/cold service supply line 790, the divert valve 781, a pasteurizer/cooler service supply line 791, the pasteurizer/cooler 716, a pasteurizer/cooler return line 793, a pasteurizer/cooler check valve 783, a pasteurizer/cooler hot/cold service return line 794, and to the hot/cold service 717. The service water thus flowing through the pasteurizer/cooler 716 is used to adjust the temperature of the product to the desired temperature. The pasteurizer/cooler R.T.D. sensor 719 senses the temperature of the product leaving the pasteurizer/cooler and sends a pasteurizer/cooler R.T.D. signal 719*a* back to the hot/cold service 717 to automatically regulate the product temperature. The heat retention loop 720 is optionally used to help maintain the temperature of the product for an extended period of time after the product leaves the pasteurizer/cooler 716.

The zone heater/cooler 721 is used to adjust the temperature of the product after it has left the pasteurizer/cooler 716. The zone heater/cooler utilizes service water from the zone heater/cooler hot/cold service 722. This service water circulates through the zone heater/cooler by means of a zone heater/cooler service supply lines 723, and is used to further adjust the temperature of the product to a desired temperature. The zone heater/cooler R.T.D. sensor 724 senses the temperature of the product leaving the pasteurizer/cooler and sends a signal 724*a* back to the zone heater/cooler hot/cold service 722 to automatically regulate the product temperature.

Once product flowing through the filler R.T.D. 742 reaches the desired temperature, the filler 3-way switch 744 activates the filler divert valve 743 to divert product into the filer. Containers are now sent to the filler 745 and filled with product. This process continues until the end of the run, or until a product change.

4. Filler line product recovery procedure

Once the line tank goes empty, turn the balance tank 3-way switch 705 to the "off" position, thus turning off the line tank pump 310 in the line tank product recovery module 248 (See FIGS. 2 and 3). Send compressed air/gas 305 through check valve 306 (in line tank product recovery module 248), preferably for approximately 15 to 20 seconds of at a flow rate approximately equivalent to 80 c.f.m. within a schedule 40 steel pipe having a nominal diameter of 2 inches, or as required to expel substantially all the product through product line 304, past the pump 310, and past the second check valve 314. Immediately send compressed air/gas 312 through check valve 314 (in line tank product recovery module 248), preferably for approximately 20 seconds at a flow rate approximately equivalent to 80 c.f.m. within a schedule 40 steel pipe having a nominal diameter of 2 inches, to evacuate the remainder of product from the product recovery module product line 304, the line tank product line 250, and into the balance tank 703.

When the balance tank 703 is nearly empty of product (approximately 50 gallons remaining or at the filler operator's discretion), slow down the filler feed tank pump 737 to a very slow flow rate. Open the filler return tank second divert valve 759 to divert product to the heat exchanger product line 760, the heat exchanger sight glass 761, the heat exchanger 726, the filler product line 787, the heat exchanger R.T.D. sensor 788, the filler check valve 789, the filler R.T.D. 742, the filler divert valve 743, and into the filler 745.

Send compressed air/gas 762 through filler return tank third check valve 763, preferably for approximately 30 seconds at a flow rate approximately equivalent to 80 c.f.m. within a schedule 40 steel pipe having a nominal diameter of 2 inches, or as required to evacuate the remainder of product from the balance tank return product line 773, the balance tank heater/cooler 764, the balance tank heater/cooler sight glass 767, and the heater/cooler divert valve 768, into the balance tank 703.

When the balance tank 703 goes completely empty, turn the balance tank pump 712 off. Close the balance tank first valve 708. Immediately send compressed air/gas 709 through the balance tank first check valve 710, preferably for approximately 10 seconds at a flow rate approximately equivalent to 80 c.f.m. within a schedule 40 steel pipe having a nominal diameter of 2 inches, or as required to evacuate the remainder of product from the balance tank product line 701 past the balance tank divert valve 711, the balance tank pump 712, and past the balance tank second check valve 714. Immediately send compressed air/gas 713 through the balance tank second check valve 714, preferably for approximately 60 seconds at a flow rate approximately equivalent to 80 c.f.m. within a schedule 40 steel pipe having a nominal diameter of 2 inches, or as required to evacuate the remaining product from the balance tank product line 701, the balance tank second valve 715, the pasteurizer/cooler 716, the pasteurizer/cooler R.T.D. sensor 719, the heat retention loop 720, the zone heater/coolers 721, the zone heater/cooler R.T.D. sensor 724, the zone heater/cooler sight glass 725, and the zone heater/cooler divert valve 727, into the filler feed tank 730. Use the sight glass 725, or alternately an automatic sensory device, to verify that substantially all the product has been evacuated into the filler feed tank 730. Once this occurs, turn off compressed air/gas 713.

Now activate the pasteurizer/cooler divert valve 781 to divert service water into a heat exchanger service supply line 795, so that the heat exchanger 726 can utilize service water from the pasteurizer/cooler hot/cold service 717 to adjust or maintain the temperature the remaining product flowing through the filler line system. During this stage of product recovery, the service water from the hot/cold service 717 is flowing through the following lines and equipment: the pasteurizer/cooler hot/cold service supply line 790, the divert valve 781, the heat exchanger service supply line 795, the heat exchanger 726, a heat exchanger service return line 796, the heat exchanger check valve 774, the pasteurizer/cooler hot/cold service return line 794, and to the hot/cold service 717. The service water now flowing through the heat exchanger 726 is used to adjust the temperature of the product to the desired temperature. Essentially, the heat exchanger 726 is now serving the same function as the pasteurizer/cooler 716 served during the transfer of product from the line tank into the containers at the filler 745. The heat exchanger R.T.D. sensor 788 senses the temperature of the product leaving the heat exchanger 726 and sends a heat exchanger R.T.D. signal 788*a* back to the hot/cold service 717 to automatically regulate the product temperature.

Slow down the filler 745 as the filler feed tank 730 begins to empty, as verified by a filler feed tank sight glass 732, or alternately by a suitable automatic sensor. Activate the filler feed tank second divert valve 784 to divert the remaining product into the blowdown line 786 and into the filler return tank 748. At this stage in the recovery process, the filler return tank pump 756 becomes the filler feed pump.

Continue pumping product from the filler feed tank 730 until the tank goes empty. Turn off the filler feed tank pump 737. Send compressed air/gas 733 through filler fed tank first check valve 734, preferably for approximately 15 seconds at a flow rate approximately equivalent to 80 c.f.m. within a schedule 40 steel pipe having a nominal diameter of 2 inches, or as required to evacuate the remaining product through the filler feed tank product line 740, the filler feed tank first divert valve 735, the filler feed tank pump 737, and past the filler feed tank second check valve 739. Then immediately send compressed air/gas 738 through filler feed tank second check valve 739, preferably for approximately 60 seconds at a flow rate approximately equivalent to 80 c.f.m. within a schedule 40 steel pipe having a nominal diameter of 2 inches, or as required to evacuate the remaining product through the filler feed tank product line 740, the filler feed tank second divert valve 784, the blowdown line 786, and into the filler return tank 748.

Continue slowing down the filler 745 and filling containers until the filler return tank 748 is empty, as verified by the filler return tank sight glass 750, or alternately as verified by use of a suitable automatic sensory device. Turn the filler return tank 3-way switch 771 to the "off" position, thus deactivating the filler return tank pump 756. Send compressed air/gas 752 through the filler return tank first check valve 753, preferably for approximately 60 seconds at a low pressure of approximately 15 to 20 p.s.i., or as required to evacuate the remainder of product from the filler return tank product line 751 and through the following product lines and equipment: the filler return tank first divert valve 754, the filler return tank pump 756, the filler return tank second check valve 758, the filler return tank second divert valve 759 (open into the heat exchanger product line 760), the heat exchanger product line 760, the heat exchanger sight glass 761, the heat exchanger 726, the filler product line 787, the heat exchanger R.T.D. sensor 788, the filler check valve 789, the filler R.T.D. 742, the filler divert valve 743, into the filler 745, and into the containers.

When containers are filled with the last remaining product, substantially all of the product originally introduced into the filler line has been placed into containers. Turn off the compressed air/gas 752. Turn the hot/cold service 717 off. Repeat the entire rinse procedure described above in Section III.D.1, titled "Filler Line Rinse Procedure," and the rinse water evacuation procedure described above in Section III.D.2, titled "Filler Line Rinse Water Compressed Air/gas Evacuation Procedure." The filler line depicted in FIG. 7 is now ready for a product change, or ready to be shut down.

E. PREFERRED COMPONENTS FOR EXAMPLES 1, 2, 3, AND 4

In a preferred embodiment of the preceding examples of container filling line recovery systems, the following components have been utilized successfully, although other components which function in an equivalent manner can also be used:

| | |
|---|---|
| Balance Tanks 403 and 703<br>Balance/Filler Feed Tanks 503 and 603<br>Filler Feed Tanks 430 and 730<br>Filler Return Tanks 448, 548, 648, and 748 | 316 stainless steel tanks manufactured by Mueller Tanks, Feldmeyer, and A.P.V. Crepaco have been successfully utilized. |
| Valves 402, 408, 502, 508, 602, and 608 | Defonex 316 stainless steel butterfly valves |
| Divert Valves 411, 427, 435, 454, 459, 468, 511, 527, 535, 554, 559, 568, 611, 627, 654, 659, 668, 702, 711, 727, 784, 781, 754, 759, and 768 | Tri Clover 316 stainless steel pneumatic divert valves |
| Check Valves (w gas/air) 410, 414, 434, 439, 453, 458, 463, 510, 514, 553, 558, 563, 610, 614, 653, 658, 663, 710, 714, 734, 739, 753, 758, and 763 | Tri Clover 316 stainless steel ball check valves with a Tri Clover stainless steel air/gas blow attachment. |
| Check Valves 529, 574, 629, 636, 674, 675, 774, 783, 785, 789 | Tri Clover 316 stainless steel standard in-line check valve |

-continued

| | |
|---|---|
| Filler Divert Valves 443, 543, 643, and 743 | Tri Clover 316 stainless steel pneumatic divert valves. Three positions: OFF - Normally closed to divert into filler bypass line, ON - open to filler, AUTO - controlled by filler R.T.D. and filler 3-way switch. |
| Pasteurizer/Coolers 416, 516, 616, and 716 | 316 stainless steel pasteurizer/coolers manufactured by Thermaline, Feldmeyer, A.P.V. Crepaco have been successfully utilized |
| Heat Retention Loops 420, 520, 620, and 720 | 316 stainless steel heat retention loops manufactured by Thermaline, Feldmeyer, A.P.V. Crepaco have been successfully utilized |
| Zone Heater/Cooler 421, 521, 621, and 721 | 316 stainless steel zone heater/coolers manufactured by Thermaline, Feldmeyer, A.P.V. Crepaco have been successfully utilized. |
| Heater/Cooler (balance tank product return line) 464, 564, 664, and 764 | 316 stainless steel heater/coolers manufactured by Thermaline, Feldmeyer, A.P.V. Crepaco have been successfully utilized. |
| Sight Glasses 425, 428, 461, 467, 525, 528, 561, 567, 625, 661, 667, 680, 725, 728, 761, and 767 | 316 steel in-line sight glasses manufactured by Jensen or Defonex. |
| Sight Glasses 407, 432, 450, 507, 550, 607, 650, 707, 732, and 750 | Tank sight glasses integral to a tank, manufactured by Thermaline, Feldmeyer, A.P.V. Crepaco have been successfully utilized. |
| Heat Exchanger 426, 526, 626, and 726 | 316 stainless steel heat exchanger, in triple tube, double tube and plate pack configurations, manufactured by Thermaline, Feldmeyer, A.P.V. Crepaco have been successfully utilized. |
| R.T.D. sensors 419, 424, 442, 519, 524, 542, 619, 624, 628, 642, 719, 724, 742, and 788 | Resistive Thermal Device manufactured by Pyromation |
| 3-Way Switches 405, 444, 471, 505, 544, 571, 605, 644, 671, 705, 744, and 771 | Three position switch manufactured by Alan Bradley Electrical Components. The three switch positions are OFF, ON, and AUTO. |
| Fillers 445, 545, 645, and 745 | Fillers manufactured by U.S. Bottlers, Inc., and Laub Hunt have been successfully used to fill glass and plastic containers. Fillers manufactured by F.M.C. Food Precessing Equipment, and Elmar Industries, have been successfully used to fill cans. |
| High/Low Probes 404, 470, 504, 570, 604, 670, 704, and 770 | High/low conductivity probe manufactured by Luminite Corporation |
| Hot/Cold Service 417, 422, 465, 517, 522, 565, 617, 622, 665, 717, 722, and 765 | Hot/cold service units manufactured by Thermaline, Feldmeyer, A.P.V. Crepaco have been successfully utilized. |

F. ALTERNATE FILLER LINE PRODUCT RECOVERY

In addition to the filler lines depicted in FIGS. 4, 5, 6, and 7, the new product recovery method and apparatus of the present invention can also be applied to filler lines of much simpler design. In an alternate preferred embodiment of the present invention a filler line consists of a line tank (such as line tank 238 in FIG. 2), which functions as a holding tank for a product connected to a filler (such as filler 745 in FIG. 7) by a product line (such as product line 501 in FIG. 5), with the following equipment sequentially interposed in the product line from the line tank to the filler a line tank valve (such as valve 246), a water source (preferably a "T" valve with a water attachment such as water 302 and "T" valve 303), a check valve with a air/gas blow attachment (such as check valve 710 with air/gas 709 in FIG. 7), and a pump (such as pump 712 in FIG. 7).

In the first step of the product recovery process for this simplified filler line, a rinsed and empty line tank is loaded with product. The water source is then used to rinse the product line, check valve, pump and filler. Once the entire filler line is thoroughly rinsed, the water source is turned off. Compressed air/gas is sent through the check valve, at a velocity and for a period of time required to thoroughly clear the filler line of all remaining rinsing water. The rinsing water is thus pushed into to the filler, where it flows out into a drain. The line tank valve (normally closed) is then opened, and product is allowed to flow through the product line, past the check valve, into the pump, thus priming the pump. The pump is then activated, pumping the product forward to the filler. Containers are sent to the filler and loaded with the product. Once the line tank is empty, compressed air/gas is sent through the check valve, at a velocity and for a period of time required to thoroughly clear the filler line of all remaining product. The compressed air/gas is thus used to push the remaining product into the filler, where it flows into containers. Once substantially all of the remaining product has been pushed into containers, the compressed air/gas is turned off. The containers are then removed from the filler, and rinsing water is again sent into the product line to rinse the entire filler line.

Application of the product recovery method and apparatus of the present invention to a filler line of this simple design achieves the same results as application of the present invention to the more complex filler lines depicted in FIGS. 4, 5, 6, and 7. The product does not come into contact with the rinse water, because of the compressed air/gas buffer which is used to sequentially and consecutively evacuate the rinse water and product from the filler line. Thus, substantially all of the product can be recovered while remaining substantially undiluted by the rinse water.

G. AUTOMATED PRODUCT RECOVERY

It is contemplated that the operation of the apparatus of the present invention can be fully automated by the use of automated device controllers, logic circuits, and suitable automatic sensor devices. It is intended that the "filler line operator," and the "filler line operator's discretion," in the present invention can be replaced by automated equipment, sensor devices and logic circuits. Accordingly, the description of the apparatus and process steps of the present invention are believed to be, and are intended to be, sufficient to permit a person skilled in the art of designing and programming automated control systems to fully automate, without undue experimentation, the product recovery system which is the subject of the present invention.

CONCLUSION

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiment set forth herein but to include all possible embodiments which can be embodied within the scope encompassed and equivalents thereof with respect to the features set out in the appended claims.

What is claimed is:

1. A method for the recovery of a product during the transfer of the product between a tanker truck and a tank, comprising the steps of a. rinsing a tank and a pump connected by a product line with water;

b. evacuating the rinsing water from the product line, the pump, and the tank by using a compressed air/gas;

c. connecting the product line to a tanker truck;

d. transferring a product from the tanker truck to the tank through the product line with a pump, until the pump is no longer primed with the product;

e. pushing the remaining product with a compressed air/gas through the product line, the pump, and into the tank, thereby recovering substantially all the product remaining in the product line and the pump.

2. A method for the recovery of a product during the transfer of the product between a holding tank and a receiving tank, comprising the steps of a. rinsing the receiving tank, a pump, and an interconnected product line with rinse water;

b. evacuating the rinse water from the receiving tank, the pump, and the product line by using compressed air/gas;

c. transferring the product from the holding tank to the receiving tank through the product line with a pump, until the pump is no longer primed with the product;

d. pushing the remaining product with compressed air/gas through the product line, the pump, and into the receiving tank, thereby recovering substantially all the product remaining in the product line.

3. A method for recovering a product from a filling line being used to fill containers with the product, comprising the steps of a. rinsing a filling line with rinse water, said filling line comprising at least a filler, a pump, a check valve/compressed air/gas, a water source, and a holding tank containing the product, all interconnected by a product line;

b. evacuating the rinse water from the filling line by using the compressed air/gas;

c. transferring the product from the holding tank to the filler, and then into containers, through the filler line with a pump, until the pump is no longer primed with the product;

d. pushing the remaining product with the compressed air/gas through the filler line into the filler and then into containers, thereby recovering substantially all the product remaining in the filler line.

* * * * *